US005985534A

United States Patent [19]

Maruyama

[11] Patent Number: 5,985,534

[45] Date of Patent: Nov. 16, 1999

[54] SILVER HALIDE PHOTOGRAPHIC EMULSION AND PHOTOGRAPHIC MATERIAL USING THE SAME

[75] Inventor: Yoichi Maruyama, Kanagawa, Japan

[73] Assignee: Fuji Photo Film Co., Ltd., Yanagawa, Japan

[21] Appl. No.: 08/857,509

[22] Filed: May 16, 1997

Related U.S. Application Data

[63] Continuation of application No. 08/516,552, Aug. 18, 1995, Pat. No. 5,702,878.

[30] Foreign Application Priority Data

Aug. 22, 1994 [JP] Japan ..... 6-218302
Sep. 20, 1994 [JP] Japan ..... 6-250151

[51] Int. Cl.[6] ..... G03C 1/035
[52] U.S. Cl. ..... 430/567; 430/569
[58] Field of Search ..... 430/567, 569

[56] References Cited

U.S. PATENT DOCUMENTS 4,806,461 2/1989 Ikeda et al. ..... 430/567
5,068,173 11/1991 Takehara et al. ..... 430/567
5,395,745 3/1995 Maruyama et al. ..... 430/567
5,478,717 12/1995 Ikeda et al. ..... 430/567
5,702,878 12/1997 Maruyama ..... 430/567

*Primary Examiner*—Mark F. Huff
*Attorney, Agent, or Firm*—Birch, Stewart, Kolasch & Birch, LLP

[57] ABSTRACT

A silver halide photographic emulsion is disclosed, comprising silver halide tabular grains having integrated therein dislocation lines and having an aspect ratio of 1.5 or more and a circle-corresponding diameter of 0.6 μm or less, wherein the grains having integrated therein dislocation lines from the site determined by the following expression (I) occupy 50% or more of the total projected area:

$$D=(1.4S^{1.5})\times 100\pm 15 \quad \text{(I)}$$

wherein D represents a ratio (%) of silver amount consumed until the integration of the dislocation lines to the total amount of silver used and S represents a sphere-corresponding diameter (μm) of a final grain, provided that D is 5 or more.

11 Claims, 1 Drawing Sheet

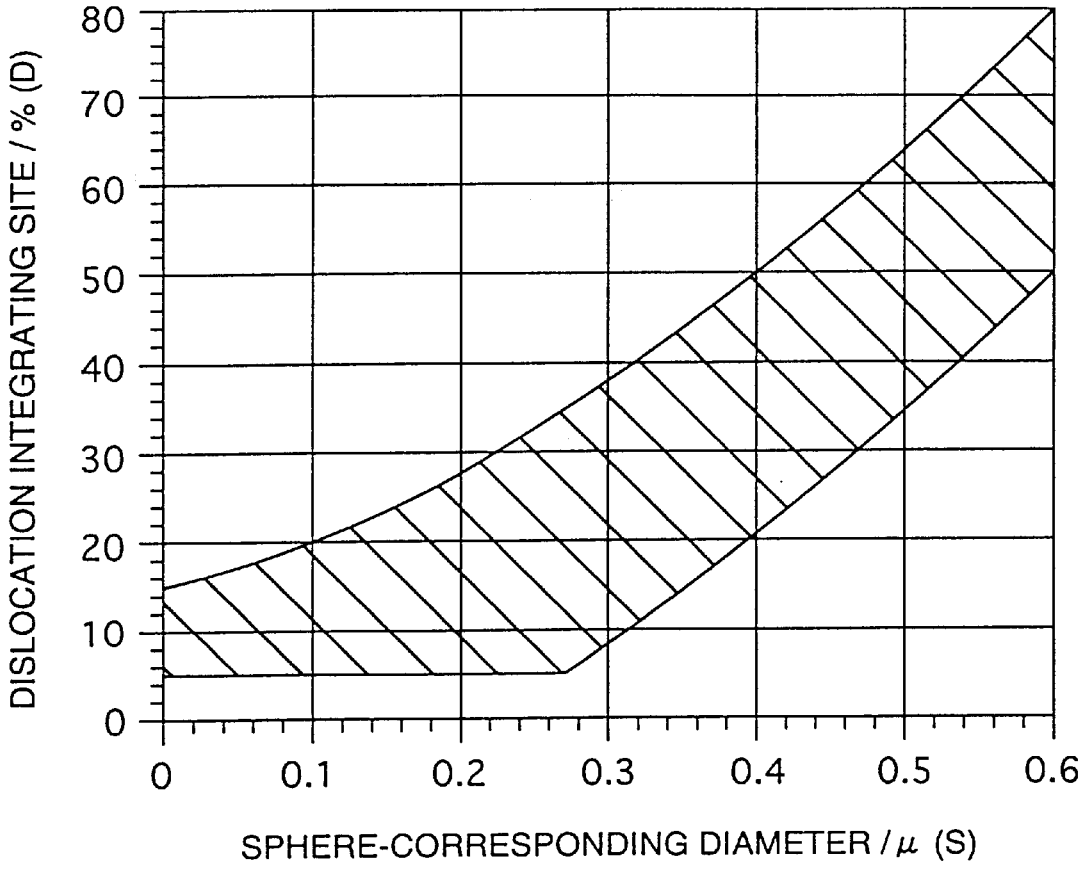
DISLOCATION INTEGRATING SITE / % (D)
80
70
60
50
40
30
20
10
0
0
0.1
0.2
0.3
0.4
0.5
0.6
SPHERE-CORRESPONDING DIAMETER / μ (S)

SILVER HALIDE PHOTOGRAPHIC EMULSION AND PHOTOGRAPHIC MATERIAL USING THE SAME

This application is a cotinuation of application Ser. No. 08/516,552 filed on Aug. 18, 1995, the entire contents of which are hereby incorporated by reference now U.S. Pat. No. 5,702,878.

FIELD OF THE INVENTION

The present invention relates to a silver halide photographic emulsion and a silver halide photographic material using the same, more specifically, it relates to a hard gradation silver halide photographic emulsion having an excellent sensitivity/granularity ratio and a silver halide photographic material using the same.

BACKGROUND OF THE INVENTION

A technical advance in a silver halide color photographic material for photographing is continuing and a photographic material in an ISO 400 class conventionally called an ultrahigh sensitivity film has come into common use by general users.

In order to achieve high sensitivity and high image quality, various investigations have been made. For instance, JP-A-58-113930 (the term "JP-A" as used herein means an "unexamined published Japanese patent application"), JP-A-58-113934 and JP-A-59-119350 disclose a multi-layer color photographic material having high sensitivity and improved in granularity, sharpness and color reproducibility by using a tabular silver halide emulsion having an aspect ratio of 8 or more. The tabular silver halide grain is advantageous because it has a large grain surface area even with the same volume as compared with a cubic, octahedral or massive grain and therefore, a large amount of sensitizing dye can be used, whereby light absorption can be increased and high sensitivity and high image quality can be achieved.

Also, JP-A-63-220238 discloses that by integrating dislocation lines, the tabular silver halide grain can have high sensitivity.

Further, JP-A-62-18555, JP-A-62-99751, JP-A-62-115435 and JP-A-63-280241 disclose that the sharpness can be improved by using a tabular grain having a circle-corresponding diameter of 0.6 $\mu$m or less.

However, the above-described conventional techniques are insufficient in considering tabular grains in a small size region having a circle-corresponding diameter of 0.6 $\mu$m or less and a more hard gradation tabular emulsion having yet excellent sensitivity/granularity ratio and being in a small size region has been demanded.

SUMMARY OF THE INVENTION

Accordingly, the object of the present invention is to provide a hard gradation tabular emulsion in a small size region having an excellent sensitivity/granularity ratio and a circle-corresponding diameter of 0.6 $\mu$m or less and a photographic material using the same.

The object of the present invention has been achieved by:

(1) a silver halide photographic emulsion comprising silver halide tabular grains having integrated therein dislocation lines and having an aspect ratio of 1.5 or more and a circle-corresponding diameter of 0.6 $\mu$m or less, wherein the grains having integrated therein dislocation lines from the site determined by the following expression (I) occupy 50% or more of the total projected area:

$$D=(1.4S^{1.5})\times 100\pm 15 \quad \text{(I)}$$

wherein D represents a ratio (%) of silver amount consumed until the integration of the dislocation lines to the total amount of silver used and S represents a sphere-corresponding diameter ($\mu$m) of a final grain, provided that when D is less than 5, D is deemed as 5;

(2) the silver halide photographic emulsion as described in item (1), wherein the silver halide tabular grain is a grain formed while abruptly producing iodide ions;

(3) a silver halide photographic material comprising a support having thereon at least one silver halide emulsion layer, wherein the silver halide emulsion layer uses a silver halide emulsion described in item (1) or (2);

(4) a silver halide emulsion comprising silver halide tabular grains having integrated therein dislocation lines and having an aspect ratio of 1.5 or more and a circle-corresponding diameter of 0.6 $\mu$m or less, wherein the tabular grains having a ratio of the average dislocation line length to the grain size of 0.2 or more occupy 50% or more of the total projected area;

(5) the silver halide photographic emulsion as described in item (4), wherein grains in the silver halide emulsion have a monodisperse grain size distribution;

(6) the silver halide photographic emulsion as described in item (4), wherein the silver halide emulsion has a surface silver iodide content of 3 mol % or less;

(7) the silver halide photographic emulsion as described in item (4), wherein the silver halide tabular grain is a grain formed while abruptly producing iodide ions; and (8) a silver halide photographic material comprising a support having thereon at least one silver halide emulsion layer, wherein the silver halide emulsion layer uses a silver halide emulsion described in any one of items (4) to (7).

BRIEF DESCRIPTION OF THE DRAWING

The FIGURE shows the relation between the sphere-corresponding diameter S ($\mu$m) in the final size and the dislocation integrating site D given in terms of silver amount (%).

DETAILED DESCRIPTION OF THE INVENTION

The present invention will be described below in detail.

In the present invention, the silver halide grain in at least one silver halide emulsion layer on the support is a tabular silver halide grain having an aspect ratio of 1.5 or more. The term "tabular grain" as used herein is a generic term for the grain having one twin plane or two or more parallel twin planes. The twin plane means a {111} face when ions at all lattice points are in a mirror-image relation between both sides of the {111} face. When observed the grain from the upside thereof, the tabular grain is in a triangular or hexagonal form or the circular form as a rounded triangle or hexagon and the triangular, hexagonal and circular grain have triangular, hexagonal and circular outer surfaces in parallel with each other, respectively.

The aspect ratio of the tabular grain of the present invention means a value determined on tabular grains having a grain size of 0.1 $\mu$m or more and is obtained by dividing the diameter of each grain by the thickness. The grain thickness can be easily determined by depositing a metal onto a grain together with a latex for control from the slantwise direction, measuring the length of a shadow thereof on a microphotograph and calculating therefrom by referring to the shadow length of the latex.

The circle-corresponding diameter as used in the present invention means a diameter of a circle having an area equal to the projected area of a parallel outer surface of a grain.

The projected area of a grain can be obtained by measuring the area on a microphotograph and then correcting the magnification at the projection.

The circle-corresponding diameter of the tabular grain. is preferably from 0.15 to 0.6 $\mu$m. The thickness of the tabular grain is preferably from 0.05 to 0.3 $\mu$m.

The average aspect ratio can be obtained as an arithmetic mean of the aspect ratio of each grain measured on usually at least 100 silver halide grains. The average aspect ratio can also be obtained as a ratio of the average diameter to the average thickness of grains.

In the present invention, tabular silver halide grains having an aspect ratio of 1.5 or more occupy 50% or more, preferably from 70 to 100%, more preferably from 80 to 100% of the total projected area of silver halide grains in the emulsion layer.

By using tabular grains having a monodisperse grain size distribution, further preferred effects may be obtained. With respect to the structure and the production method of the monodisperse tabular grain, for example, JP-A-63-151618 may be referred to, but briefly stated here on the shape thereof, 70% or more of the total projected area of silver halide grains are occupied by tabular silver halide in a hexagonal form having a ratio of (the length of a side having the longest length) to (the length of a side having the shortest length) of 2 or less and at the same time, having two parallel planes as the outer surface, and the hexagonal tabular silver halide grains are monodisperse having a coefficient of variation in the grain size distribution (namely, a value obtained by dividing the distribution (standard deviation) in the grain size expressed by the diameter in terms of a circle of the projected area of a grain by the average grain size) of preferably 25% or less, more preferably 20% or less, most preferably 15% or less.

The tabular grain for use in the present invention has dislocation lines and the dislocation lines of the tabular grain can be observed by a direct method using a transmission type electron microscope at low temperature described, for example, in J. F. Hamilton, *Phot. Sci. Eng.*, 11, 57 (1967) and T. Shiozawa, *J. Soc. Phot. Sci. Japan*, 35, 213 (1972). More specifically, a silver halide grain taken out from an emulsion carefully so as not to apply such a pressure as to cause generation of dislocation lines on the grain is placed on a mesh for observation by an electron microscope and observed according to a transmission method while laying the sample in a cool state so as to prevent any damage (e.g., print out) by the electron beams. At this time, as the thickness of the grain is thicker, the electron beams become hard to be transmitted and therefore, a high-voltage type (200 kV or more to the grain having a thickness of 0.25 $\mu$m) electron microscope is preferably used to effect the observation more clearly. The site and the number of dislocation lines on each grain can be determined by observing the grain from the direction perpendicular to the main plane on the photograph of the grain obtained as above.

The number of dislocation lines is 5 or more on average, more preferably 10 or more on average per one grain. In the case when the dislocation lines are present crowdedly or intersected with each other on the observation, the number of dislocation lines per one grain cannot be accurately counted in some cases. However, even in these cases, an approximate number such as about 10, 20 or 30 lines can be counted.

The average number of dislocation lines per one grain can be obtained as the number average of dislocation lines counted on 100 or more grains.

In the present invention, the ratio of the dislocation line length to the average grain size is 0.2 or more. The average of the dislocation lines is determined one by one per a grain. The dislocation lines can be easily observed according to the above-described method.

In this case, some dislocation lines observed may be generated in the center region of the main surface and cannot reach the side constituting the outer circumference. In determining the average of the dislocation line length, these dislocation lines are eliminated and the length of only the dislocation lines reaching the edge is measured and defined as an average.

On the other hand, the grain size as used herein means the length of a perpendicular line drawn from the center of a tabular grain to the side constituting the outer circumference. The center of a tabular grain as used herein means a point serving as a center when an outline circle passing the peak of the tabular grain is configurated. The ratio of the average dislocation line length to the grain size is preferably from 0.20 to 1.0, more preferably from 0.20 to 0.75, still more preferably from 0.20 to 0.50.

The dislocation lines may be present nearly uniformly throughout the entire outer circumference of a tabular grain or may be present at a local site on the outer circumference. More specifically, for example, in the case of a hexagonal tabular silver halide grain, the dislocation lines may be limited only to the neighborhood of six peaks or may be limited only to the neighborhood of one peak among them. On the contrary, the dislocation lines may be limited only to sides exclusive of the neighborhood of six peaks.

Accordingly, the sites of the dislocation lines may be limited to on the outer circumference, on the main plane or at the local site, or the dislocation lines may be formed on these sites together, that is, may be present on the outer circumference and on the main plane at the same time.

The dislocation lines can be integrated into a tabular grain by providing a specific high silver iodide layer inside the grain. The high silver iodide layer includes a high silver iodide region provided discontinuously. More specifically, a base grain is prepared, a high silver iodide layer is provided thereon and a layer having a silver iodide content lower than that of the high silver iodide layer covers the outside thereof. The base tabular grain has a silver iodide content lower than that of the high silver iodide layer and preferably of from 0 to 20 mol %, more preferably from 0 to 15 mol %.

The high silver iodide layer inside the grain means a silver halogen solid solution containing silver iodide. In this case, the silver halide is preferably silver iodide, silver iodobromide or silver chloroiodobromide and more preferably silver iodide or silver iodobromide (each having a silver iodide content of from 10 to 40 mol %). The high silver iodide layer inside the grain (hereinafter referred to as an inner high silver iodide layer) may be selectively provided on the edge, at the corner or on the plane of the base grain by controlling the production condition of the base grain, the production condition of the inner high silver iodide layer and the production condition of a layer covering the outside of the layer. In the production condition of the base grain, the pAg (a logarithm of a reciprocal of silver ion concentration) and the presence or absence, kind, amount and temperature of the silver halide solvent are important. By growing the base grain at a pAg of 8.5 or less, preferably 8 or less, the inner high silver iodide layer can be provided selectively in the vicinity of the peak or on the plane of the base grain. On the other hand, by growing the base grain at a pAg of 8.5 or more, preferably 9 or more, the inner high silver iodide layer can be provided on the edge of the base grain. The threshold value of the pAg is raised or lowered depending upon the temperature and the presence or absence, the kind and the amount of the silver halide solvent. For example, if thiocyanate is used as the silver halide solvent, the threshold value of the pAg deviates towards a higher value. The particularly important pAg at the growth time is a pAg at the final stage of the growth of the base grain. However, even if the pAg at the growth time does not meet the above-described requirement, the selective site of the inner high silver iodide layer can be controlled by adjusting the pAg after the growth of the base grain to fall within the above-described range and ripening the grain. At this time, the effective silver halide solvent is an ammonia, an amine compound, a thiourea derivative or a thiocyanate. The inner high silver iodide layer may be produced by a so-called conversion method. This method includes a method where, during the grain formation, a halogen ion having a solubility of a salt for forming a silver ion smaller than that of the halogen ion forming the grain or the vicinity of the grain surface at this time is added, but in the present invention, the halogen ion having a smaller solubility added is preferably present in an amount greater than a certain value (involving the halogen composition) to the surface area of the grain at this time. For example, KI is added during the grain formation preferably in an amount within a certain range to the surface areas of the silver halide grain at this stage. More specifically, the iodide salt is preferably added in an amount of from $8.2\times10^{-5}$ to $2.4\times10^{-4}$ mol/m$^2$.

The inner high silver iodide layer is more preferably produced by adding an aqueous silver salt solution at the same time with the addition of an aqueous halide salt solution containing an iodide salt.

For example, an aqueous $AgNO_3$ solution is added at the same time with the addition of an aqueous KI solution by a double jet method. At this time, the addition initiation time and the addition completion time of the aqueous KI solution may be faster or later than those of the aqueous $AgNO_3$ solution. The addition molar ratio of the aqueous $AgNO_3$ solution to the aqueous KI solution is preferably 0.1 or more, more preferably 0.5 or more, still more preferably 1 or more. The total addition molar amount of the aqueous $AgNO_3$ solution may be in a silver excess region to the halogen ion in the system and the iodide ion added. The pAg at the double jet addition of the aqueous halide solution containing these iodide ions and the aqueous silver salt solution is preferably reduced along the time of the double jet addition. The pAg before the initiation of addition is preferably from 6.5 to 13, more preferably from 7.0 to 11. The pAg after the completion of addition is most preferably from 6.5 to 10.0.

In practicing the above-described method, the silver halide in the mixing system preferably has a solubility as low as possible. Accordingly, the temperature in the mixing system at the time of forming a high silver iodide layer is preferably from 30 to 80° C., more preferably from 30 to 70° C.

The inner high silver iodide layer is formed most preferably by adding fine particle silver iodide (fine silver iodide, hereinafter the same), fine particle silver iodobromide, fine silver chloroiodide or fine silver chloroiodobromide. The addition of fine particle silver iodide is particularly preferred. These fine particles has a particle size of usually from 0.01 to 0.1 μm, however, fine particles having a particle size of 0.01 μm or less, or of 0.1 μm or more may also be used. With respect to the preparation method of these fine particle silver halide grain, JP-A-1-183417, JP-A-2-44335, JP-A-1-183644, JP-A-1-183645, JP-A-2-43534 and JP-A-2-43535 may be referred to. By adding the fine particle silver halide and ripening a mixture, an inner high silver iodide layer can be provided. In ripening the fine particle to dissolve, the above-described silver halide solvent may also be used. The fine particles added need not be thoroughly dissolved at once to vanish, but it may suffice if the fine particles are dissolved out and vanish at the time of completion of final grains.

With respect to the site of the inner high silver iodide layer provided so as to integrate dislocation lines, the tabular grain of the present invention must satisfy the following expression (I):

$$D=(1.4S^{1.5})\times100\pm15 \quad \text{(I)}$$

wherein D represents a silver amount consumed until the integration of dislocation lines (namely, the dislocation integrated site or the dislocation initiated site) and S represents a sphere-corresponding diameter (μm), and provided that D is at least 5.

The region represented by expression (I) is shown in the figure.

The range ±15 is preferably ±10, more preferably ±5.

It is absolutely unexpected that to specify the dislocation line integration site as above is important for the tabular grain in a small size region of the present invention in view of the photographic property. According to the present invention, a hard gradation tabular emulsion having a sensitivity/granularity ratio far surpassing that of the hitherto known tabular emulsion in a small size region can be obtained.

The amount of silver halide for forming the inner high silver iodide layer is, in terms of silver amount, 30 mol % or less, more preferably 20 mol % or less based on the whole grains.

The high silver iodide layer can be observed according to *Journal of Imaging Science and Technology*, Vol. 38, p. 10 (1994).

The outer layer for covering the inner high silver iodide layer has a silver iodide content lower than that of the high silver iodide layer and the silver iodide content is preferably from 0 to 30 mol %, more preferably from 0 to 20 mol %, most preferably from 0 to 10 mol %.

The temperature and the pAg at the time of forming the outer layer for covering the inner high silver iodide layer may be freely selected, however, the temperature is preferably from 30 to 80° C., most preferably from 35 to 70° C. and the pAg is preferably from 6.5 to 11.5, more preferably from 6.5 to 9.5. The use of the above-described silver halide solvent is preferred in some cases and the most preferred silver halide solvent is a thiocyanate.

Another method for integrating dislocation lines into a tabular grain is such that a base grain is prepared, silver halochloride is deposited, the silver halochloride is formed into a high silver bromide or high silver iodide layer through conversion and a shell is provided on the outer periphery of the layer. The silver halochloride may be silver chloride or may be silver chlorobromide or silver chloroiodobromide each having a silver chloride content of 10 mol % or more, preferably 60 mol % or more. The silver halochloride may be deposited on the base grain by adding separately or simultaneously an aqueous silver nitrate solution and an aqueous solution of an appropriate alkali metal salt (e.g., potassium chloride), or may be deposited by adding an emulsion comprising such a silver salt and ripening a mixture. The silver halochloride may be deposited at any pAg region but the pAg is most preferably from 5.0 to 9.5. The amount of the silver halochloride layer is, in terms of silver, from 1 to 80 mol %, more preferably from 2 to 60 mol % based on the base grain. Dislocation lines can be integrated into a tabular grain as a result of conversion of the silver halochloride layer with an aqueous halide solution capable of forming a silver salt having a solubility lower than that of the silver halochloride. For example, the silver halochloride layer is converted with an aqueous KI solution and then a shell is grown to obtain a final grain. The halogen conversion of the silver halochloride layer does not mean that the layer is thoroughly replaced by a silver salt having a solubility lower than that of the silver halochloride but means that the layer is replaced by a silver salt having a lower solubility in the proportion of preferably 5% or more, more preferably 10% or more, most preferably 20% or more. Dislocation lines can be integrated into a local portion on the main plane by controlling the halogen structure of the base grain on which a silver halochloride layer is provided. For example, if a base grain having an inner high silver iodide structure is displaced on use to the transverse direction of a base tabular grain, the dislocation lines can be integrated only at the peripheral part of the main plane exclusive of the center part of the main plane. Also, if a base grain having an outer high silver iodide structure is displaced on use to the transverse direction of a base tabular grain, the dislocation lines can be integrated only to the center part of the main plane exclusive of the peripheral part thereof. Further, it is also possible that a local governing substance for the epitaxial growth of the silver halochloride, for example, an iodide is used to deposit the silver halochloride only on an areally limited portion and the dislocation lines are integrated only to that portion. The temperature at the deposition of the silver halochloride is preferably from 30 to 70° C., more preferably from 30 to 50° C. The silver halochloride after deposition may be subjected to conversion and then to the growth of a shell, or the silver halochloride after deposition may be subjected to halogen conversion while growing a shell.

The site of the inner silver halochloride layer is preferably present in the range, from the center of a grain, of from 5 to less than 100 mol %, more preferably from 20 to less than 95 mol %, still more preferably from 50 to less than 90 mol %, based on the silver amount of whole grains.

The shell has a silver iodide content of preferably from 0 to 30 mol %, more preferably from 0 to 20 mol %. The temperature and the pAg at the time of shell formation may be freely selected, but the temperature is preferably from 30 to 80° C., most preferably from 35 to 70° C. and the pAg is preferably from 6.5 to 11.5. In some cases, a silver halide solvent described above may be preferably used and the most preferred silver halide solvent is a thiocyanate. In the final grain, the inner silver halochloride layer subjected to halogen conversion may not be confirmed by the above-described analysis for the halogen composition depending upon the condition such as degree of the halogen conversion, however, the dislocation lines can be clearly observed.

This method for integrating dislocation lines and the method for integrating dislocation lines described above can also be appropriately combined to integrate dislocation lines.

In the present invention, the silver iodide content of the surface layer is determined by an ISS (ion scattering spectrum) method. The ISS method is described, for example, in T. M. Buck, *Methods of Surface Analysis*, ed. by A. W. Czanderna, Elsevier, Amsterdam (1975) and M. Aono, *Shinku*, 26 (1983) 136.

On the measurement of the surface silver iodide content by the ISS method, from the outermost surface layer to the ten atom layer often show a profile capable of approximation by the expression: $Y=A\exp(-Bx)+C$, wherein A is a silver iodide content of the outermost surface layer, C is a silver iodide content in a constant state, Y is a silver iodide content and X is a distance from the outermost surface layer to the depth direction. The silver iodide content of the surface layer as used in the present invention means a value represented by C in the expression shown above.

As a result of intensive investigations, the present inventors have found that a highly sensitivity and hard gradation, small-size tabular emulsion can be obtained by setting the silver iodide content of the surface layer to 3 mol % or less. The reason is not yet known, however, it is assumed because if the silver iodide content of the surface layer is high, desensitization and reduction of developability due to the diffusion of chemical sensitization specks are put into an extreme level.

The photographic material of the present invention is preferably a multi-layer color photographic material comprising a support having thereon at least one silver halide emulsion layer and at least one light-insensitive layer, more preferably has a color image forming unit consisting of a red-sensitive silver halide emulsion layer, a green-sensitive silver halide emulsion layer and a blue-sensitive silver halide emulsion layer on a support. Further, the photographic material of the present invention comprises a support having thereon at least two silver halide emulsion layers sensitive to light in substantially different wavelength regions, the emulsion layer containing a non-diffusible color coupler capable of forming a dye upon coupling with an oxidation product of an aromatic primary amine developing agent, more preferably comprises a support having thereon a blue-sensitive silver halide emulsion layer containing a yellow coupler, a green-sensitive silver halide emulsion layer.containing a magenta coupler and a red-sensitive silver halide emulsion layer containing a cyan coupler. The multi-layer color photographic material of the present invention is subjected to a processing with a bleaching solution or a bleach-fixing solution after exposure and development.

In the present invention, the silver halide emulsion contains a binder and silver halide and it is usually produced through grain formation, physical ripening, desalting (water washing) and chemical sensitization in the presence of a hydrophilic colloid. The silver halide emulsion of the present invention is preferably uses gelatin as a main component of the binder and it is preferably subjected to chemical sensitization and further to spectral sensitization.

In the present invention, the silver halide grain is light sensitive and it is subjected to chemical sensitization and preferably further to spectral sensitization.

The production method of the photographic material of the present invention usually comprises addition of photographic useful substances to a photographic coating solution, namely, to a hydrophilic colloid solution.

The photographic material of the present invention is usually processed, after imagewise exposure, with an alkali developer containing a developing agent and subjected to image formation according to a method comprising the processing of a color photographic material after color development, with a processing solution having a bleaching ability and containing a bleaching agent.

The effect of the present invention is particularly outstanding when the grain formation is conducted while abruptly producing iodide ions using an iodide ion-releasing agent represented by formula (II):

R—I (II)

wherein R represents a monovalent organic residue which releases an iodine atom in the form of an iodide ion upon reaction with a base and/or a nucleophilic reagent.

The iodide ion-releasing agent represented by formula (II) of the present invention partially overlaps the compound used for rendering the halogen composition uniform within the grain and among grains of respective silver halides described in JP-A-2-68538.

However, the present inventors have found that a high sensitivity silver halide emulsion being low in fogging can be obtained by conducting the silver halide grain formation while abruptly producing iodide ions in the presence of an iodide ion-releasing agent represented by formula (II). In particular, an iodide ion release-conditioning agent is preferably used in combination with the compound represented by formula (II). A base and/or a nucleophilic reagent can be used as an iodide ion release-conditioning agent.

The iodide ion-releasing agent represented by formula (II) will be described below in detail.

In the compound represented by formula (II), R is preferably an alkyl group having from 1 to 30 carbon atoms, an alkenyl group having from 2 to 30 carbon atoms, an alkynyl group having from 2 to 3 carbon atoms, an aryl group having from 6 to 30 carbon atoms, an aralkyl group having from 7 to 30 carbon atoms, a heterocyclic group having from 4 to 30 carbon atoms, an acyl group having from 1 to 30 carbon atoms, a carbamoyl group, an alkyloxycarbonyl group having from 2 to 30 carbon atoms, an aryloxycarbonyl group having from 7 to 30 carbon atoms, an alkylsulfonyl group having 1 to 30 carbon atoms, an arylsulfonyl group having from 6 to 30 carbon atoms or a sulfamoyl group.

R is more preferably one of the above-described group having 20 or less carbon atoms, particularly preferably 12 or less carbon atoms. The number of carbons preferably falls in the above-described range in view of the solubility and the addition amount.

Also, R is preferably substituted. The substituent may further be substituted by other substituent.

Preferred examples of the substituent include a halogen atom (e.g., fluorine, chlorine, bromine, iodine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentinyl), an aralkyl group (e.g., benzyl, phenetyl), an aryl group (e.g., phenyl, naphthyl, 4-methylphenyl), a heterocyclic group (e.g., pyridyl, furyl, imidazolyl, piperidyl, morphoryl), an alkoxy group (e.g., methoxy, ethoxy, butoxy), an aryloxy group (e.g., phenoxy, naphthoxy), an amino group (e.g., unsubstituted amino, dimethylamino, ethylamino, anilino), an acylamino group (e.g., acetylamino, benzoylamino), a ureido group (e.g., unsubstituted ureido, N-methylureido, N-phenylureido), an urethane group (e.g., methoxycarbonylamino, phenoxycarbonylamino), a sulfonylamino group (e.g., methylsulfonylamino, phenylsulfonylamino), a sulfamoyl group (e.g., sulfamoyl, N-methylsulfamoyl, N-phenylsulfamoyl), a carbamoyl group (e.g., carbamoyl, diethylcarbamoyl, phenylcarbamoyl), a sulfonyl group (e.g., methylsulfonyl, benzenesulfonyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g. , phenoxycarbonyl) , an acyl group (e.g., acetyl, benzoyl, formyl, pivaloyl), an acyloxy group (e.g., acetoxy, benzoyloxy), a phosphoric acid amido group (e.g., N,N-diethylphosphoric acid amido), an alkylthio group (e.g., methylthio, ethylthio), an arylthio group (e.g., phenylthio), a cyano group, a sulfo group, a carboxyl group, a hydroxy group, a phosphono group and a nitro group.

More preferred examples of the substituent for R include a halogen atom, an alkyl group, an aryl group, a 5- or 6-membered heterocyclic group containing at least one of O, N and S, an alkoxy group, an aryloxy group, an acylamino group, a sulfamoyl group, a carbamoyl group, an alkylsulfonyl group, an arylsulfonyl group, an aryloxycarbonyl group, an acyl group, a sulfo group, a carboxyl group, a hydroxy group and a nitro group.

The substituent of R is particularly preferably a hydroxy group, a carbamoyl group, a lower alkyl sulfonyl group or a sulfo group (inclusive of a salt thereof) when it substitutes to an alkylene group, and a sulfo group (inclusive of a salt thereof) when it substitutes to a phenylene group.

The compound represented by formula (II) of the present invention is more preferably a compound represented by formula (III) or (IV).

The compound represented by formula (III) of the present invention will be described below.

(III)

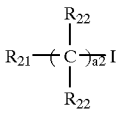

wherein $R_{21}$ represents an electron withdrawing group, $R_{22}$ represents a hydrogen atom or a group which can be substituted and $n_2$ represents an integer of from 1 to 6, preferably from 1 to 3, more preferably 1 or 2.

The electron withdrawing group represented by $R_{21}$ is preferably an organic group having a Hammett's $\sigma_p$, $\sigma_m$ or $\sigma_I$ value greater than 0.

The Hammett's $\sigma_p$ and $\sigma_m$ values are described in *Yakubutsu no Kozo Kassei Sokan*, Nan'kodo, p. 96 (1979) and the Hammett's $\sigma_I$ is described in ibid., p. 105. The electron withdrawing group can be selected by referring to the list in the publication.

Preferred examples of the electron withdrawing group represented by $R_{21}$ include a halogen atom (e.g., fluorine, chlorine, bromine), a trichloromethyl group, a cyano group, a formyl group, a carboxylic acid group, a sulfonic acid group, a carbamoyl group (e.g., unsubstituted carbamoyl group, diethylcarbamoyl), an acyl group (e.g., acetyl, benzoyl), an oxycarbonyl group (e.g., methoxycarbonyl, ethoxycarbonyl), sulfonyl group (e.g., methanesulfonyl, benzenesulfonyl), a sulfonyloxy group (e.g., methanesulfonyl), a carbonyloxy group (e.g., acetoxy), a sulfamoyl group (e.g., unsubstituted sulfamoyl, dimethylsulfamoyl) and a heterocyclic group (e.g., 2-thienyl, 2-benzoxazolyl, 2-benzothiazolyl, 1-methyl-2-benzimidazolyl, 1-tetrazolyl, 2-quinolyl). The carbon-containing group for $R_{21}$ contains preferably from 1 to 20 carbon atoms.

Examples of the group which can be substituted represented by $R_{22}$ include those described above for the substituent of R.

The $R_{22}$ groups contained in plurality in the compound represented by formula (III) are half and more preferably hydrogen atoms. The $R_{22}$ groups present in plurality in the molecule may be the same or different.

$R_{21}$ and $R_{22}$ each may be further substituted and preferred examples of the substituent include those described for the substituent of R.

$R_{21}$ and $R_{22}$ or two or more of $R_{22}$ groups may be combined to form a 3-, 4-, 5- or 6-membered ring, such as cyclopropyl, cyclopentyl or cyclohexyl.

The compound represented by formula (IV) is described below.

(IV)

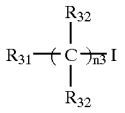

wherein $R_{31}$ represents an $R_{33}O$— group, an $R_{33}S$— group, an $(R_{33})_2N$— group, an $(R_{33})_2P$— group or a phenyl group (wherein $R_{33}$ represents a hydrogen atom, an alkyl group having from 1 to 30 carbon atoms, an alkenyl group having from 2 to 30 carbon atoms, an alkynyl group having from 2 or 3 carbon atoms, an aryl group having from 6 to 30 carbon atoms, an aralkyl group having from 7 to 30 carbon atoms or a heterocyclic group having from 4 to 30 carbon atoms). The number of carbons preferably falls in the above-described range in view of the solubility and the addition amount.

When $R_{31}$ represents an $(R_{33})_2N$— group or an $(R_{33})_2P$— group, the two $R_{33}$ groups may be the same or different. $R_{31}$ is preferably an $R_{33}O$— group.

$R_{32}$ has the same meaning as $R_{22}$ in formula (III) and the $R_{32}$ groups in plurality may be the same or different. Examples of the group which can be substituted represented by $R_{32}$ include those described for the substituent of R. $R_{32}$ is preferably a hydrogen atom.

$n_3$ is preferably 1, 2, 4 or 5 and particularly preferably 2.

$R_{31}$ and $R_{33}$ each may further be substituted and preferred examples thereof include those described for the substituent of R.

$R_{31}$ and $R_{32}$ or two or more $R_{32}$ groups may be combined to form a ring, such as cyclopropyl, cyclopentyl or cyclohexyl.

Specific examples of the compounds represented by formulae (II), (III) and (IV) are set forth below, but the present invention is by no means limited to these compounds.

(1) $ICH_2COOH$ (2) $ICH_2CONH_2$ (3) $ICH_2CN$ (4) $I(CH_2)_2COOH$ (5) $I(CH_2)_3COOH$ (6)

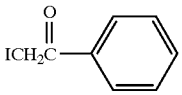

(7)

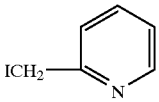

(8)

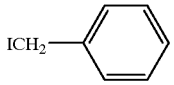

(9) $I(CH_2)_2SO_3Na$

(10) $I(CH_2)_2SO_2CH_3$

(11) $I(CH_2)_2OH$

(12) $I(CH_2)_3OH$

(13) $I(CH_2)_4OH$

(14) $ICH_2CHOH$
$|$
$CH_3$

-continued

(15) $ICH_2CHOH$

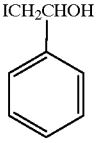

(16) $ICH_2CHCH_2OH$
$|$
OH

(17) $ICH_2CHCH_2SO_3Na$
$|$
OH (18)

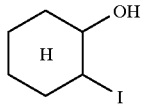

(19) $ICH_2CH\ CHCH_2I$
$|\quad\ |$
OH OH (20)

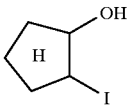

(21) ICHCOOH

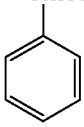

(22) $I(CH_2)_2SO_2CH_2CONH_2$

(23) $I(CH_2)_2NH_2$

(24) $I(CH_2)_2NHSO_2CH_3$

(25) $I(CH_2)_2NHCOCH_3$

(26) $I(CH_2)_2OCH_3$

(27) $I(CH_2)_2SCH_3$ (28)

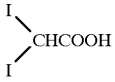

(29) $ICH_2CHCH_2I$
$|$
OH

(30) $I(CH_2)_2SO_2NH_2$ (31)

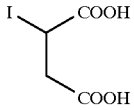

(32)

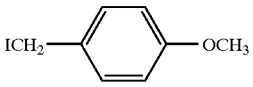

(33)

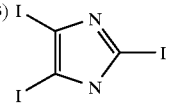

(34)

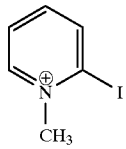

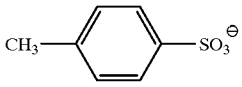

(35)

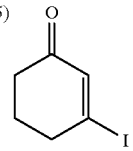

(36)

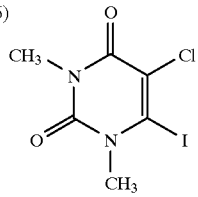

(37)

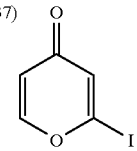

(38)

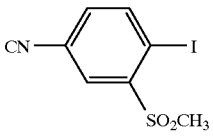

(39)

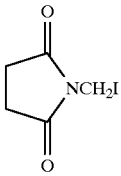

-continued (40)

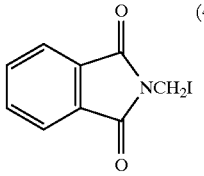

(41)

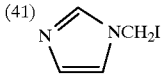

(42)

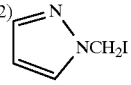

(43)

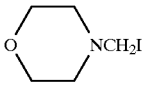

(44)

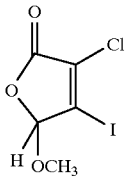

(45)

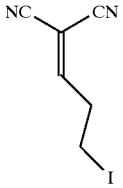

(46)

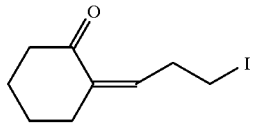

(47) $I(CH_2)_5COOH$ (48)

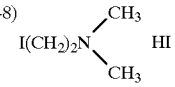

(49) $I(CH_2)_2N(CH_3)SO_2CH_3$

(50) $I(CH_2)_2OCOCH_3$

(51) $I(CH_2)_2N(CH_3)COCH_3$ (52)

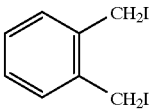

(53)

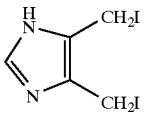

(54)

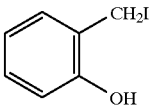

(55)

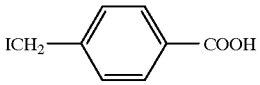

(56)

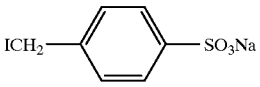

(57) $ICH_2CONH(CH_2)_2—SO_3Na$ (58)

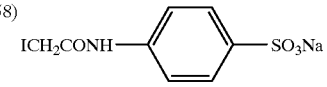

(59)

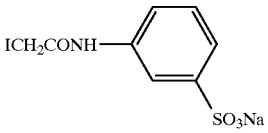

(60)

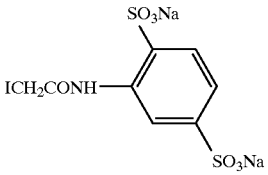

(61)

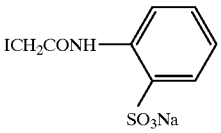

(62)

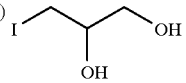

(63)

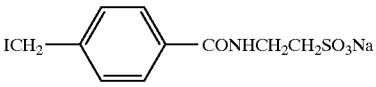

-continued (64)

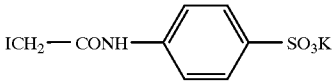

(65)

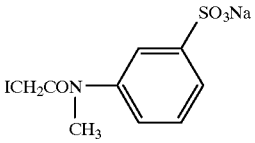

(66)

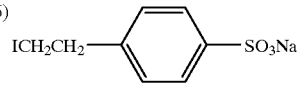

(67) $ICHCONHCH_2CH_2SO_3Na$

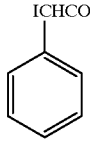

(68)

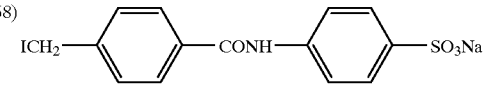

(69)

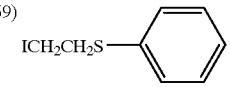

The iodide ion-releasing agent for use in the present invention can be synthesized according to the synthesis methods described in the following publications.

*J. Am. Chem. Soc.*, 76, 3227–8 (1954), *J. Org. Chem.*, 16, 798 (1951), *Chem. Ber.*, 97, 390 (1960), *Org. Synth.*, V, 478 (1973), *J. Chem. Soc.*, 1951, 1851, *J. Org. Chem.*, 19, 1571 (1954), *J. Chem. Soc.*, 1952, 142, *J. Chem. Soc.*, 1955, 1383, *Angew. Chem.*, Int. Ed., 11, 229 (1972) and *Chem. Commu.*, 1971, 1112.

The iodide ion-releasing agent for use in the present invention releases an iodide ion upon reaction with an iodide ion release-conditioning agent (a base and/or a nucleophilic reagent) and the nucleophilic reagent used to this effect include the following chemical species.

Examples thereof include hydroxide ions, sulfite ions, hydroxylamine, thiosulfate ions, metabisulfite ions, hydroxamic acids, oximes, dihydroxybenzenes, mercaptanes, sulfinates, carboxylates, ammonia, amines, alcohols, ureas, thioureas, phenols, hydrazines, hydrazides, semicarbazides, phosphines and sulfides.

In the present invention, the rate and time of releasing the iodide ion can be controlled by controlling the concentration of the base or the nucleophilic reagent, the addition method or the temperature of the reaction solution. The base is preferably an alkali hydroxide.

The iodide ion-releasing agent and the iodide ion release-conditioning agent used for abruptly producing an iodide ion each is used at a concentration of preferably from $1\times10^{-7}$ to 20 M, more preferably from $1\times10^{-5}$ to 10 M, still more preferably from $1\times10^{-4}$ to 5 M and most preferably from $1\times10^{-3}$ to 2 M.

The concentration exceeding 20 M is not preferred because the iodide ion releasing agent having a large molecular weight or the addition amount of the iodide ion-release-conditioning agent becomes too large to the volume of the grain formation vessel.

The concentration less than $1\times10^{-7}$ is also not preferred because the iodide ion release reaction rate is retarded and thereby, the abrupt production of an iodide ion becomes difficult.

The temperature of the reaction solution is preferably from 30 to 80° C., more preferably from 35 to 75° C., most preferably from 35 to 60° C.

If the temperature exceeds 80° C., the iodide ion release reaction rate generally becomes too high, whereas if the temperature is lower than 30° C., the iodide ion release reaction rate is retarded too much, thus, these high and low temperatures restrict the use conditions and are not preferred.

In the present invention, when a base is used on the release of an iodide ion, the pH of the solution may be varied.

In this case, the pH range preferred for controlling the rate and time of releasing an iodide ion is, after the adjustment of the pH, preferably from 2 to 12, more preferably from 3 to 11, still more preferably from 5 to 10 and most preferably from 7.5 to 10.0. Even under the neutral condition at a pH of 7, the hydroxide ion decided by the ionic product of water acts as a conditioning agent.

Further, the nucleophilic reagent and the base may be used in combination and also in this case, the pH is varied within the above-described range to control the rate and time of releasing an iodide ion.

The iodide ion is released from the iodide ion releasing agent in an amount of preferably from 0.1 to 20 mol %, more preferably from 0.3 to 15 mol %, still more preferably from 1 to 10 mol % based on the total silver halide amount, however, the amount may be selected depending upon the purpose. The addition amount exceeding 20 mol % is not preferred because the development rate is generally retarded.

When an iodine atom is released in the form of an iodide ion from the iodide ion-releasing agent, all iodine atoms may be released or a part of iodine atoms may not be decomposed and remain.

The releasing rate of the iodide ion from the iodide ion-releasing agent is described below in detail.

In the present invention, in view of integrating dislocation lines at a high density, it is preferred, for example, to form a silver halide layer containing silver iodide on the edge of a tabular grain while abruptly producing iodide ions during the integration process of the dislocation lines. If the feeding rate of the iodide ion is too slow, in other words, if the formation of a silver halide layer containing silver iodide takes a prolonged time, the silver halide layer containing silver iodide redissolves during that time and the dislocation line density is reduced. On the other hand, locality (non-uniform distribution) of iodide ions is not generated if the iodide ions are fed slowly. That is, the slow feeding is preferred in view of uniform integration of dislocation lines within a grain and among grains.

Accordingly, it is important to produce iodide ions abruptly but not to generate locality (non-uniform distribution). A region large in the locality of iodide ions is generated because the iodide ion releasing reaction proceeds too fast to the locally uneven distribution in the concentration of additives, which appears in the vicinity of the inlet for the addition, when an iodide ion-releasing agent or an iodide ion release-conditioning agent used in combination therewith is added to a reaction solution in a grain formation vessel.

The released iodide ion deposits on a host grain very fast and since the grain growth is brought about in the region around the inlet for the addition where the locality of iodide ions is large, non-uniform grain growth among grains results. Therefore, the iodide ion-releasing rate must be selected so as not to cause locality of iodide ions.

Conventional methods (for example, comprising adding an aqueous solution of potassium iodide) are bounded to limitation in reducing the locality of iodide ions because the iodide ion is added in a free state even if the aqueous solution of potassium iodide is diluted and then added. In other words, uniform growth in a grain and among grains has been hardly achieved in the grain formation conducted according to conventional methods. However, by the present invention capable of controlling the iodide ion-releasing rate, the locality of iodide ions can be reduced as compared with the conventional methods. The present inventors considered that a high density dislocation restricted substantially only to the fringe part of tabular grain cannot be integrated uniformly into a grain and among grains by using a conventional iodide ion feeding method which accompanies a large locality of iodide ions and then they have attempted to integrate the dislocation into a tabular grain by using a method for abruptly producing an iodide ion which accompanies reduced locality of iodide ions. As a result, the present inventors have found that dislocation lines can be uniformly integrated into a grain and among grains while keeping the high density and restricting substantially only to the fringe part of the tabular grain.

In the present invention, as described above, the iodide ion-releasing rate can be determined by controlling the temperature and the concentration of the iodide ion-releasing agent and the iodide ion release-conditioning agent and may be selected according to the object.

In the present invention, the iodide ion-releasing rate is preferably a rate such that from 50 to 100% of total weight of the iodide ion releasing agent present in the reaction solution in the grain formation vessel can accomplish the release of iodide ions within a continuous time of from 1 to 180 seconds, more preferably within 120 seconds, still more preferably within 60 seconds.

The term "within continuous 180 seconds" as used herein means the time within 180 seconds where the iodide ion-releasing reaction continues and the iodide ion-releasing time may be determined by starting from any point during the continuous reaction.

In the case when the iodide ion-releasing reaction term is divided into two or more sections, the iodide ion-releasing rate may be obtained based on the iodide ion-releasing agent present at the measuring point in the reaction solution by starting from any point during the first iodide ion-releasing reaction term or any point during the second or subsequent iodide ion-releasing reaction term.

If the releasing rate exceeds 180 seconds, the releasing rate is generally too slow, whereas if it is less than 1 second, the releasing rate is too fast, wherefore the use condition is limited. The same goes for the case where less than 50% of the iodide ion-releasing agent accomplishes the release.

The releasing rate is more preferably such that from 70 to 100%, more preferably from 80 to 100%, still more preferably from 90 to 100% of the iodide ion-releasing agent present in the reaction solution in the grain formation vessel can accomplish the release of iodide ions within continuous 180 seconds.

In the case when the reaction for abruptly producing iodide ions can be expressed by a second-order reaction (in water, at 40° C.) wherein the reaction rate is substantially proportional to the concentration of the iodide ion-releasing agent and the concentration of the iodide ion release-conditioning agent, the second-order reaction rate constant of the present invention is preferably from $5\times10^{-3}$ to 1,000 ($M^{-1}.sec^{-1}$), more preferably from $5\times10^{-2}$ to 100 ($M^{-1}.sec^{-1}$), still more preferably from 0.1 to 10 ($M^{-1}.sec^{-1}$).

The substantially second-order reaction means here that the coefficient of correlation is from 0.8 to 1.0. Representative examples of the second-order reaction rate constant k ($M^{-1}.sec^{-1}$) determined in water at 40° C. at the concentration of the iodide ion-releasing agent of from $10^{-5}$ to $10^{-4}$ M and the concentration of the iodide ion release-conditioning agent of from $10^{-4}$ to $10^{-1}$ M under conditions which can be regarded as a pseudo-first-order reaction are shown below.

| Compound No. | Iodide Ion-Release Conditioning Agent | k |
|---|---|---|
| 11 | hydroxide ion | 1.3 |
| 1 | sulfite ion | $1 \times 10^{-3}$ or less |
| 2 | " | 0.29 |
| 58 | " | 0.49 |
| 63 | " | 1.5 |
| 22 | hydroxide ion | 720 |

If the k exceeds 1,000, the release is too fast to if it is less than $5\times10^{-3}$, the release is too slow to achieve the effect of the present invention.

The release of iodide ions in the present invention is preferably controlled as follows.

Iodide ions are released from an iodide ion-releasing agent which is already added to and uniformly distributed in the reaction solution in the grain formation vessel by varying the pH, the concentration of the nucleophilic substance or the temperature, usually by changing from a low pH to a high pH, to uniformly control the reaction solution as a whole.

In order to raise the pH on the release of iodide ions, the alkali and the nucleophilic substance used in combination are preferably added in a state where the iodide ion-releasing agent is uniformly distributed over the entire.

The emulsion of the present invention and other emulsion to be used in combination therewith are described below.

The silver halide grain for use in the present invention is silver bromide, silver chloride, silver iodide, silver chlorobromide, silver chloroiodide, silver iodobromide or silver chloroiodobromide. A silver salt other than these, for example, silver rhodanide, silver sulfide, silver selenide, silver carbonate, silver phosphate or organic acid silver, may be contained as a separate grain or a part of silver halide grain.

The silver halide emulsion of the present invention preferably has a distribution or structure of halogen composition in the grain. Typical examples thereof include a core-shell type or double structure type grain having different halogen compositions between the inside and the outer layer of the grain as described in JP-B-43-13162 (the term "JP-B" as used herein means an "examined Japanese patent publication"), JP-A-61-215540, JP-A-60-222845, JP-A-60-143331 and JP-A-61-75337. Not only merely a double structure but also a triple structure as disclosed in JP-A-60-222844 or a greater multilayer structure may be used, or silver halide having a different composition may be thinly laminated onto the surface of a core-shell double-structure grain.

In order to provide a structure in the inside of a grain, not only the wrapped structure as described above but also a so-called junction structure may be provided to the grain. Examples thereof are described in JP-A-59-133540, JP-A-58-108526, EP-A-199290, JP-B-58-24772 and JP-A-59-16254. The crystal to be joined has a composition different from the host crystal and can be joined to the edge, corner or face part of the host grain. The junction crystal can be formed either when the host crystal has a uniform halogen composition or a core-shell type structure.

In the case of the junction structure, silver halide and silver halide are of course combined but a silver salt compound not having a rock-salt structure, such as silver rhodanide and silver carbonate, can be combined with silver halide to provide a junction structure. Also, a non-silver salt compound such as lead oxide may be used if the junction structure can be provided.

In the case, for example, of a silver iodobromide grain or the like having a structure as described above, the silver iodide content of the core part is preferably higher than that of the shell part. On the contrary, in some grains, it is preferred that the silver iodide content of the core part is low and that of the shell part is high. Also, in the grain having a junction structure, one embodiment may be such that the host crystal has a high silver iodide content and the joined crystal has a relatively low silver iodide content, and another embodiment may be reversal thereto. The boundary between portions different in the halogen composition of a grain having a structure as described above may be either clear or unclear. Also, it is a preferred embodiment to provide a continuous change in the composition positively.

In the case of a silver halide grain in the form of a mixed crystal consisting of two or more silver halides or a silver halide grain having a structure, the control of the halogen composition distribution between grains is important. The measuring method of the halogen composition distribution between grains is described in JP-A-60-254032. The uniform halogen distribution between grains is a preferred property. In particular, an emulsion having a high uniformity with the coefficient of variation being 20% or less is preferred. Another preferred embodiment is an emulsion having a correlation between the grain size and the halogen composition. An example thereof is a case where a correlation such that the larger size grain has a higher iodide content and the smaller size grain has a lower iodide content is present. Depending upon the purpose, a reversal correlation or a correlation to other halogen composition may be selected. For this purpose, two or more emulsions having different compositions are preferably mixed.

The control of the halogen composition in the vicinity OL the grain surface is important. To increase the silver iodide content or the silver chloride content in the vicinity of the surface involves the change in the adsorptivity of a dye or the developing rate and therefore, it may be selected depending upon the purpose. In the case when the halogen composition in the vicinity of the surface is varied, either a structure such that the grain is wholly embraced or a structure such that only a part of the grain is adsorbed may be selected. For example, the halogen composition may be varied only on one surface of a tetradecahedral grain comprising a {100} face and a {111} face or the halogen composition may be varied on one plane of the main plane and the side plane of a tabular grain.

The silver halide grain for use in the emulsion of the present invention or in the emulsion other than that of the present invention but used in combination may be a regular crystal free of twin planes or a crystal as described in *Shashin Kogyo no Kiso, Gin-en Shashin Hen*, compiled by Nippon Shashin Gakkai, p. 163 (Corona Sha) such as a single twin crystal containing one twin plane, a parallel multiple twin crystal containing two or more parallel twin planes or a non-parallel multiple twin crystal containing two or more non-parallel twin planes and these crystals may be selected depending upon the purpose. An example of the mixing of grains having different forms is disclosed in U.S.

Pat. No. 4,865,964 and this method may be selected, if desired. In the case of a regular crystal, a cubic form comprising a {100} face, an octahedral form comprising a {111} face or a dodecahedral form comprising {110} face disclosed in JP-B-55-42737 and JP-A-60-222842 may be used. Further, as described in *Journal of Imaging Science*, Vol. 30, p. 247 (1986), a (h11) face grain represented by (211) face, (hh1) face grain represented by (311) face, a (hk0) face grain represented by (210) face or a (hk1) face grain represented by (321) face may also be selected and used depending on the purpose although their preparation requires an advanced technique. A grain having two faces or a plurality of faces together may also be selected and used depending on the purpose and examples thereof include a tetradecahedral grain having a {100} face and a {111} face together in one grain, a grain having {100} face and a {110} face together and a grain having a {111} face and a {110} face together.

A so-called aspect ratio is a value obtained by dividing a circle-corresponding diameter of a projected area by a grain thickness and defines the form of a tabular grain. The tabular grains having an aspect ratio of 1 or more can be used in the present invention. The tabular grain can be prepared according to the methods described in Cleve, *Photography Theory and Practice*, p. 131 (1930), Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157. The use of a tabular grain is accompanied by advantages such that the covering power is elevated or the spectral sensitization efficiency by a sensitizing dye is increased and U.S. Pat. No. 4,434,226 cited above describes thereon in detail. The average aspect ratio of grains occupying 80% or more of the total projected area of grains is preferably from 1 to less than 100, more preferably from 2 to less than 30, still more preferably from 3 to less than 25. The form of the tabular grain may be selected from a triangle, a hexagon or a circle. A equilateral hexagon consisting of six sides having nearly the same length as described in U.S. Pat. No. 4,797,354 is a preferred embodiment.

The circle-corresponding diameter of the tabular grain is preferably from 0.15 to 5.0 $\mu$m.

The thickness of the tabular grain is preferably from 0.05 to 1.0 $\mu$m.

The thickness less than 0.05 $\mu$m is not preferred because the pressure property is deteriorated. The thickness exceeding 1.0 $\mu$m is not preferred either because the advantage of the tabular grain cannot be fully exerted.

The population ratio of the tabular grain is preferably such that tabular grain having an aspect ratio of 3 or more accounts for 50% or more, more preferably 80% or more, still more preferably 90% or more of the total projected area.

The use of a monodisperse tabular grain may provide a further preferred effect. The structure and the production of a monodisperse tabular grain are described, for example, in JP-A-63-151618 but to describe on the shape thereof briefly, 70% or more of the total projected area of silver halide grains are occupied by tabular silver halide grains in the form of a hexagon with the ratio of the length of a side having the longest length to the length of a side having a shortest length being 2 or less, having two parallel faces as the outer surface and having a monodispersibility such that the coefficient of variation (a value obtained by dividing the distribution (standard deviation) of the grain size in terms of a circle-converted diameter of the projected area by an average grain size) in the grain size distribution of the hexagonal tabular silver halide grain is 20% or less.

A grain having dislocation lines is preferably used.

In the case of a tabular grain, the dislocation lines can be observed through a transmission-type electron microscope. It is preferred to select a grain containing no dislocation line, a grain containing several dislocation lines or a grain containing a large number of dislocation lines depending upon the purpose. Also, a grain containing dislocation lines which are integrated linearly to or distorted from a specific direction of the crystal orientation may also be selected. The dislocation lines may be integrated throughout the grain, may be integrated into a specific part of the grain or may be integrated only to, for example, a fringe part of the grain. The dislocation lines are preferably integrated not only to a tabular grain but also to a regular crystal grain or an amorphous grain represented by a pebble-like grain. Also in this case, the integration site is preferably limited to a specific part such as a peak or an edge.

The silver halide emulsion for use in the present invention may be rounded as disclosed in EP-B-96727 and EP-B-64412 or may be subjected to the surface modification as disclosed in West German Patent No. 2,306,447C2 and JP-A-60-221320.

The grain surface generally has a flat structure but in some cases, unevenness may be preferably provided thereto by intention. Examples thereof include those obtained by a method where a part of the crystal, for example, a peak or a center of the plane, is perforated described in JP-A-58-106532 and JP-A-60-221320 and a ruffled grain described in U.S. Pat. No. 4,643,966.

The grain size of the emulsion for use in the present invention can be verified from a circle-corresponding diameter of a projected area using an electron microscope, from a sphere-corresponding diameter of the grain volume calculated from the projected area and the grain thickness or from a sphere-corresponding diameter of the volume according to a coultar counter method. In terms of a sphere-corresponding diameter, a grain may be selected over the range of from an ultrafine grain having a grain size of 0.05 $\mu$m or less to a giant grain having a grain size in excess of 10 $\mu$m. Preferably, a grain having a grain size of from 0.1 to 3 $\mu$m is used as a light-sensitive silver halide grain.

The regular crystal emulsion for use in the present invention may be either a so-called polydisperse emulsion having a broad size distribution or a monodisperse emulsion having a narrow size distribution. As a measure for the size distribution, a coefficient of variation in the circle-corresponding diameter of the projected area of a grain or a sphere-corresponding diameter of the volume of a grain may be used. In the case when a monodisperse emulsion is used, the coefficient of variation in the size distribution is preferably from 3 to 25%, more preferably from 3 to 20%, still more preferably from 3 to 15%.

The monodisperse emulsion may be sometimes defined to have a grain size distribution such that from 80 to 100%, by grain number or by weight, of the total grains has a grain size falling within the average grain size ±30%. In order to satisfy the gradation as a goal of the photographic material, in the emulsion layers having substantially the same spectral sensitivity, two or more kinds of monodisperse silver halide emulsions having different grain sizes may be mixed in the same layer or may be coated on separate layers in a superposed manner. Further, two or more kinds of polydisperse silver halide emulsion layers or a combination of a monodisperse emulsion and a polydisperse emulsion may be mixed or superposed.

The emulsion of the present invention and other photographic emulsion used in combination therewith can be prepared according to the methods described in P. Glafkides, *Chimie et Phisigue Photographigue*, Paul Montel (1967), G. F. Duffin, *Photographic Emulsion Chemistry*, The Focal Press (1966) or V. L. Zelikman et al, *Making and Coating Photographic Emulsion*, The Focal Press (1964). More specifically, any of acid process, neutral process and ammonia process may be used and the reaction between a soluble silver salt and a soluble halogen salt may be conducted by a single jet method, a double jet method or a combination of these. Also, the grain can be formed in an atmosphere of excess silver ions (so-called reverse mixing method). A so-called controlled double jet method, which is one system of the double jet method, of keeping constant the pAg of the liquid phase where the silver halide is formed can also be used. According to this method, the silver halide emulsion obtained can have a regular crystal form and a nearly uniform grain size.

Depending on the case, a method comprising adding a silver halide grain which is previously precipitated and formed in a reaction vessel for the preparation of an emulsion or a method described in U.S. Pat. Nos. 4,334,012, 4,301,241 and 4,150,994 is preferred. The grain may be used as a seed crystal or may be effectively supplied as a silver halide for use in the growth. In the latter case, an emulsion having a small grain size is preferably added and the emulsion may be added wholly at a time, may be added divisionally at a plurality of times or may be continuously added. Further, in order to modify the surface, it is effective according to the case to add grains having various halogen compositions.

A method for converting a majority part or merely a part of the halogen composition of a silver halide grain according to the halogen conversion method is disclosed in U.S. Pat. Nos. 3,477,852 and 4,142,900, European Patents 273429 and 273430 and West German Patent Application (OLS) No. 3,819,241 and it is an effective grain formation method. In order to effect conversion into a further difficultly soluble silver salt, a soluble halogen solution or a silver halide grain can be added. The halogen composition may be converted all at a time, may be converted dividedly at a plurality of times or may be continuously converted.

With respect to the grain growing method, in addition to the method where a soluble silver salt and a halogen salt are added at a constant concentration and at a flow rate, a method where the grain is grown by varying the concentration or varying the flow rate as described in British Patent 1,469,480 and U.S. Pat. Nos. 3,650,757 and 4,242,445 is preferred. By increasing the concentration or increasing the flow rate, the silver halide amount fed can be varies according to linear function, secondary function or more complicated function of the addition time. If desired, the silver halide amount supplied may be preferably reduced depending on the case. Further, the effective addition method includes a method where when a plurality of soluble silver salts different in the solution composition are added or when a plurality of soluble halogen salts different in the solution composition are added, one is increased and the other is decreased.

The mixing vessel used on reacting a soluble silver salt with a soluble halogen salt solution may be selected from those used in the methods described in U.S. Pat. Nos. 2,996,287, 3,342,605, 3,415,650 and 3,785,777 and West German Patent Application (OLS) Nos. 2,556,885 and 2,555,364.

In order to accelerate the ripening, a silver halide solvent is effectively used. For example, it is known to let an excessive amount of halogen ions be present in a reaction vessel so as to accelerate ripening. Other ripening agent may also be used. The ripening agent may be wholly blended into a dispersion medium in the reaction vessel before adding a silver and halide salt or may be incorporated into the reaction vessel together with the addition of a halide salt, a silver salt or a deflocculant. In another embodiment, a ripening agent may be incorporated independently at the stage of adding a halide salt and a silver salt.

Examples of the ripening agent include ammonia, a thiocyanate (e.g., potassium thiocyanate, ammonium thiocyanate), an organic thioether compound (e.g., compounds described in U.S. Pat. Nos. 3,574,628, 3,021,215, 3,057,724, 3,038,805, 4,276,374, 4,297,439, 3,704,130 and 4,782,013, JP-A-57-104926), a thione compound (e.g., quaternary substituted thiourea described in JP-A-53-82408, JP-A-55-77737, U.S. Pat. No. 4,221,863, compounds described in JP-A-53-144319), a mercapto compound capable of accelerating the growth of a silver halide grain described in JP-A-57-202531 and an amine compound (e.g., those described in JP-A-54-100717).

The use of gelatin is advantageous as a protective colloid used in the preparation of an emulsion of the present invention or as a binder in other hydrophilic colloidal layers, however, other hydrophilic colloids may also be used.

Examples thereof include proteins such as gelatin derivatives, graft polymers of gelatin to other polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid gelatin or an enzyme-processed gelatin as described in *Bull. Soc. Photo. Japan*, No. 16, p. 30 (1966), and a hydrolysate of gelatin or an enzymolysate can also be used.

The emulsion of the present invention can be preferably washed with water to provide a newly prepared protective colloid dispersion for the purpose of desalting. The temperature at the water washing may be selected according to the purpose but it is preferably selected within the range of from 5 to 50° C. The pH at the water washing may also be selected according to the purpose but it is preferably selected within the range of from 2 to 10, more preferably from 3 to 8. Further, the pAg at the water washing may also be selected depending on the purpose but it is preferably selected between 5 and 10. The water washing method may be selected from a noodle washing method, a dialysis method using a semipermeable membrane, a centrifugal separation method, a coagulation sedimentation method and an ion exchange method. In the case of coagulation sedimentation method, a method using a sulfate, a method using an organic solvent, a method using a water-soluble polymer or a method using a gelatin derivative may be selected.

At the time of preparing the emulsion of the present invention, it is preferred depending on the purpose to let a metal ion salt be present, for example, during grain formation, at the desilvering step, at the time of chemical sensitization or before coating. The metal ion salt is preferably added at the grain formation when it is doped to a grain and between after grain formation and before the completion of chemical sensitization when it is used for modification of the grain surface or as a chemical sensitizer. The metal ion salt may be doped to the entire of a grain or may be doped only to the core part, only to the shell part, only to the epitaxial part, or only to the substrate grain. Examples of the metal include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added if it is in the form of a salt capable of dissolution at the grain formation such as an ammonium salt, an acetic acid salt, a nitric acid salt, a sulfuric acid salt, a phosphoric acid salt, a hydroxy salt, 6-coordinated complex salt or a 4-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound can be selected from halo, aquo, cyano, cyanate, thiocyanate, nitrosyl, thionitrosyl, oxo and carbonyl. The metal compound may be used solely or in combination of two or more.

The metal compound is preferably added after it is dissolved in water or an appropriate organic solvent such as methanol or acetone. In order to stabilize the solution, a method where an aqueous hydrogen halogenide solution (e.g., HCl, HBr) or an alkali halogenide (e.g., KCl, NaCl, KBr, NaBr) is added may be used. Also, if desired, an acid or an alkali may be added. The metal compound may be added to the reaction vessel either before grain formation or during grain formation. Further, the metal compound may be added to a water-soluble silver salt (e.g., $AgNO_3$) or an aqueous alkali halogenide solution (e.g., NaCl, KBr, KI) and then continuously added to the reaction vessel during the silver halide grain formation. Furthermore, a solution may be prepared independently from a water-soluble silver salt or an alkali halogenide and continuously added at an appropriate time during the grain formation. A combination of various methods is also preferred.

The addition of a chalcogen compound during the preparation of an emulsion as described in U.S. Pat. No. 3,772,031 is also useful in some cases. Other than S, Se and Te, a cyanate, a thiocyanate, a selencyanate, a carbonate, a phosphate or an acetate may also be present.

The silver halide grain of the present invention may be subjected to at least one of sulfur sensitization, gold sensitization, palladium sensitization or noble metal sanitization and reduction sensitization at any step during the preparation of a silver halide emulsion. A combination of two or more sensitization methods is preferred. By selecting the step when the chemical sensitization is carried out, various types of emulsions may be prepared. The chemical sensitization specks are embedded, in one type, inside the grain, in another type, embedded in the shallow part from the grain surface, and in still another type, formed on the grain surface. In the emulsion of the present invention, the site of chemical sensitization specks may be selected according to the purpose, however, in general, it is preferred that a kind of chemical sensitization specks are formed in the vicinity of the surface.

One of the chemical sensitization which can be preferably practiced in the present invention is chalcogen sensitization, noble metal sensitization or a combination of these sensitizations. As described in T. H. James, *The Theory of the Photographic Process*, 4th ed. Macmillan, pp. 67–76 (1977), the chemical sensitization may be carried out using an active gelatin or as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755, sulfur, selenium, tellurium, gold, platinum, palladium, iridium or a combination of these sensitizing dyes in plurality may be used at a pAg of from 5 to 10, a pH of from 5 to 8 and a temperature of from 30 to 80° C. In the noble metal sensitization, a noble metal salt such as gold, platinum, palladium or iridium may be used and in particular, gold sensitization, palladium sensitization and a combination use of these two sensitizations are preferred. In the case of gold sensitization, a known compound such as chloroaurate, potassium chloroaurate, potassium aurithiocyanate, gold sulfide or gold selenide may be used. The palladium compound means a palladium divalent salt or quatervalent salt. The preferred palladium compound is represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination of a thiocyanate or a selenocyanate.

As the sulfur sensitizer, a hypo, a thiourea-based compound, a rhodanine-based compound and a sulfur-containing compound described in U.S. Pat. Nos. 3,857,711, 4,266,018 and 4,054,457 may be used. The chemical sensitization may also be carried out in the presence of a so-called chemical sensitization aid. The useful chemical sensitization aid includes compounds known to suppress the fogging and at the same time, increase the sensitization during the chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Photographic Emulsion Chemistry* (cited above), pp. 138–143.

To the emulsion of the present invention, gold sensitization is preferably used in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol per mol of silver halide. The amount of the thiocyanate compound or the selenocyanate compound is preferably from $1\times10^{-6}$ to $5\times10^{-2}$ mol per mol of silver halide.

The amount of the sulfur sensitization used for the silver halide grain of the present invention is preferably from $1\times10^{-7}$ to $1\times10^{-4}$, more preferably from $5\times10^{-7}$ to $1\times10^{-5}$ mol per mol of silver halide.

The preferred sensitization for the emulsion of the present invention includes selenium sensitization. In the selenium sensitization, known labile selenium compounds are used and specific examples of the selenium compound include colloidal metal selenium, selenoureas (e.g., N,N-dimethylselenourea, N,N-diethylselenourea), selenoketones, and selenoamides. The selenium sensitization is preferably carried out in some cases in combination with sulfur sensitization, noble metal sensitization or both of these sensitizations.

The silver halide emulsion of the present invention is preferably subjected to reduction sensitization during grain formation, before or during chemical sensitization after grain formation, or after chemical sensitization.

The reduction sensitization may be carried out by any of a method where a reduction sensitizer is added to the silver halide emulsion, a method where the emulsion is grown or ripened in a low pAg atmosphere called silver ripening at a pAg of from 1 to 7 and a method where the emulsion is grown or ripened in a high pH atmosphere called high pH ripening at a pH of from 8 to 11. Two or more of the above-described methods may also be used in combination.

The method where a reduction sensitizer is added is preferred because the reduction sensitization level can be delicately controlled.

Known examples of the reduction sensitizer include a stannous salt, an ascorbic acid or a derivative thereof, amines and polyamines, a hydrazine derivative, a formamidinesulfinic acid, a silane compound and a borane compound. In the reduction sensitization of the present invention, a compound may be selected from these known reduction sensitizers or two or more compounds may also be used in combination. Preferred compounds as the reduction sensitizer include a stannous chloride, a thiourea dioxide, a dimethylamineborane and an ascorbic aid or a derivative thereof. The addition amount of the reduction sensitizer depends on the preparation condition of the emulsion and must be selected, however, it is suitably from $10^{-7}$ to $10^{-3}$ mol per mol of silver halide.

The reduction sensitizer is first dissolved, for example, in water or an organic solvent such as an alcohol, a glycol, a ketone, an ester or an amide and then added during the grain growth. The reduction sensitizer may be added in advance to the reaction vessel but preferably it is added at an appropriate time during the grain growth. The reduction sensitizer may be added in advance to an aqueous solution of a water-soluble silver salt or a water-soluble alkali halide and the silver halide grain may be precipitated using the aqueous solution. Also, the reduction sensitizer solution may be preferably divided into several parts and added several times along the grain growth or may be preferably continuously added for a long period of time.

An oxidizing agent for silver is preferably added during the preparation of the emulsion of the present invention. The oxidizing agent for silver means a compound having a function to act on metal silver to convert it into a silver ion. In particular, a compound capable of converting very fine silver particles by-produced during grain formation or chemical sensitization of a silver halide grain into silver ions is useful. The silver ion produced as above may form a sparingly water-soluble silver salt such as silver halide, silver sulfide and silver selenide or may form an easily water-soluble silver salt such as silver nitrate. The oxidizing agent for silver may be either an inorganic material or an organic material. Examples of the inorganic oxidizing agent include an oxyacid salt such as ozone, hydrogen peroxide and an adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[(VO(O_2)(C_2H_4)_2].6H_2O$), permanganate (e.g., $KMnO_4$) and chromate (e.g., $K_2Cr_2O_7$), a halogen element such as iodine and bromine, a perhalogen acid salt (e.g., potassium periodate), a salt of high valence metals (e.g., potassium hexacyanoferrate) and a thiosulfonate.

Examples of the organic oxidizing agent include a quinone such as p-quinone, an organic peroxides such as peracetic acid and perbenzoic acid, and a compound which releases an active halogen (e.g., N-bromosuccinimide, chloramine T, chloramine B).

Preferred oxidizing agents of the present invention are an inorganic oxidizing agent such as ozone, hydrogen peroxide and an adduct thereof, a halogen element and a thiophosphonate, and an organic oxidizing agent such as quinones. In a preferred embodiment, the above-described reduction sensitization and the oxidizing agent for silver are used in combination. In using these in combination, any of a method where an oxidizing agent is used and then reduction sensitization is carried out, a method reversal thereto and a method where both are set to be present at the same time may be selected. These methods may be used either during the grain formation or in the chemical sensitization.

The photographic emulsion for use in the present invention may contain various compounds so as to prevent fogging or to stabilize photographic capacity, during preparation, storage or photographic processing of a photographic material. Specifically, a large number of compounds known as an antifoggant or a stabilizer may be added and examples thereof include thiazoles such as benzothiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazoles); mercaptopyrimidines; mercaptotriazines; thioketo compounds, e.g., oxazolinethione; and azaindenes, e.g., triazaindenes, tetrazaindenes (in particular, 4-hydroxy-substituted (1,3,3a,7)tetrazaindene) and pentazaindenes. For example, those described in U.S. Pat. Nos. 3,954,474 and 3,982,947 and JP-B-52-28660 may be used. One of preferred compounds includes the compounds described in JP-A-63-212932. The antifoggant or the stabilizer may be added at any stage according to the purpose, such as before grain formation, during grain formation, after grain formation, at the water washing step, at the dispersion after water washing, before chemical sensitization, during chemical sensitization, after chemical sensitization or before coating. These compounds may be added during preparation of an emulsion not only to exert their original effects of fogging prevention and stabilization but also for many purposes, for example, for controlling the crystal habit of the grain, for reducing the grain size, for diminishing the solubility of the grain, for controlling chemical sensitization or for controlling the arrangement of dyes.

The photographic emulsion for use in the present invention is preferably subjected to spectral sensitization by a methine dye or the like to achieve the effect of the present invention. The dye used to this end includes a cyanine dye, a merocyanine dye, a complex cyanine dye, a complex merocyanine dye, a holopolar cyanine dye, a hemicyanine dye, a styryl dye and hemioxonol dye. Particularly useful dyes are dyes belonging to the cyanine dye, the merocyanine dye and the complex merocyanine dye. To these dyes, any nucleus commonly used in a cyanine dye as a basic heterocyclic nucleus can be applied. Examples of the nucleus include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; a nucleus resulting from fusing of an alicyclic hydrocarbon ring to these nuclei; and a nucleus resulting from fusing of an aromatic hydrocarbon ring to these nuclei, e.g., an indolenine nucleus, a benzoindolenine nucleus, an indole nucleus, a benzooxazole nucleus, a naphthoxazole nucleus, a benzothiazole nucleus, a naphthothiazole nucleus, a benzoselenazole nucleus, a benzoimidazole nucleus, a quinoline nucleus. These nuclei may have a substituent on the carbon atom.

Examples of the nucleus having a ketomethylene structure which can be applied to the merocyanine dye or the complex merocyanine dye include 5- to 6-membered heterocyclic nuclei such as a pyrazoline-5-one nucleus, a thiahydantoin nucleus, a 2-thiooxazolidine-2,4-dione nucleus, a thiazolidine-2,4-dione nucleus, a rhodanine nucleus and a thiobarbituric acid nucleus.

These sensitizing dyes may be used either individually or in combination and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

In combination with a sensitizing dye, a compound which does not have a spectral sensitization action by itself or does not substantially absorb a visible light, but exhibits supersensitization may be contained in the emulsion.

The time when the sensitizing dye is added to an emulsion may be any stage known as useful in the preparation of emulsion. Most commonly, the sensitizing dye is added between after the completion of chemical sensitization and prior to the coating, but the sensitizing dye may be added at the same time with the chemical sensitizer to effect spectral sensitization and chemical sensitization simultaneous as described in U.S. Pat. Nos. 3,628,969 and 4,225,666, the sensitizing dye may be added in advance of chemical sensitization as described in JP-A-58-113928, or the sensitizing dye may be added before the completion of precipitation and formation of silver halide grains to initiate spectral sensitization. In addition, the above-described compound may be dividedly added, more specifically, a part of the compound may be added in advance of chemical sensitization and the remaining may be added after chemical sensitization as described in U.S. Pat. No. 4,225,666. Thus, the sensitization dye may be added at any stage during the formation of silver halide grains as in the method described in U.S. Pat. No. 4,183,756.

The sensitizing dye may be added in an amount of from $4\times10^{-6}$ to $8\times10^{-3}$ mol per mol of silver halide but in the case of a more preferred embodiment where the silver halide grain size is from 0.2 to 1.2 $\mu$m, the addition amount is effectively from about $5\times10^{-5}$ to $2\times10^{-3}$ mol.

The photographic material produced by using a silver halide emulsion of the present invention may suffice if at least one of a blue-sensitive silver halide emulsion layer, a green-sensitive silver halide emulsion layer and a red-sensitive silver halide emulsion layer is provided on a support and the number of the silver halide emulsion layers as well as light-insensitive layers and the arrangement order of layers are not particularly restricted. A typical example is a silver halide photographic material comprising a support having thereon at least one spectrally sensitized layer consisting of a plurality of silver halide emulsion layers having substantially the same spectral sensitivity but different light sensitivities, wherein the light-sensitive layer is a unit light-sensitive layer having spectral sensitivity to any of blue light, green light and red light. In the case of a multi-layer silver halide color photographic material, generally, a red-sensitive unit layer, a green-sensitive unit layer and a blue-sensitive unit layer are provided in this order from the support side. However, depending upon the purpose, the above arrangement order may be reversed or a layer having different light sensitivity may be superposed between layers having the same spectral sensitivity.

A light-insensitive layer such as an interlayer for respective layers may be provided between the above-described silver halide light-sensitive layers, as an uppermost layer or as the lowermost layer.

The interlayer may contain couplers and DIR compounds described in JP-A-61-43748, JP-A-59-113438, JP-A-59-113440, JP-A-61-20037 and JP-A-61-20038 and also may contain a color stain inhibitor as usually employed.

A plurality of silver halide emulsion layers constituting each unit light-sensitive layer may be in a two-layer structure consisting of a high-sensitivity emulsion layer and a low-sensitivity emulsion layer as described in West German Patent 1,121,470 and British Patent 923,045. Usually, the layers are preferably arranged so that the light sensitivity is lowered in sequence towards the support and a light-insensitive layer may also be provided between respective silver halide emulsion layers. Further, it may also be possible to provide a low-sensitivity emulsion layer farther from the support and a high-sensitivity emulsion layer nearer to the support as described in JP-A-57-112751, JP-A-62-200350 and JP-A-62-206541, JP-A-62-206543.

Specific examples of the layer arrangement include an order, from the farthest side to the support, of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side to the support. Further, as described in JP-A-56-25738 and JP-A-62-63936, a blue-sensitive layer/GL/RL/GH/RH may be arranged in this order from the farthest side to the support.

An arrangement consisting of three layers different in the light sensitivity may be taken as described in JP-B-49-15495 where a silver halide emulsion layer having the highest light sensitivity is provided as an upper layer, a silver halide emulsion layer having a light sensitivity lower than that of the upper layer as a medium layer and a silver halide emulsion layer having a light sensitivity lower than that of the medium layer as a lower layer so that the light sensitivity is lowered in sequence towards the support. Even in the case when such a three layer structure having different light sensitivities is used, as described in JP-A-59-202464, a medium-sensitivity emulsion layer/a high-sensitivity emulsion layer/a low-sensitivity emulsion layer may be provided in this order from the farthest side to the support in the same spectrally sensitized layer.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may also be used.

In the case of four or more layer structure, the layer arrangement may also be changed as described above.

Thus, various layer structures and arrangements may be selected depending on the purpose of the photographic material to be used.

The photographic material according to the present invention may contain various additives described above but it may also contain various additives other than those described above depending on the purpose.

These additives are described in more detail in *Research Disclosure*, Item 17643 (December, 1978), ibid., Item 18716 (November, 1979) and ibid., Item 308119 (December, 1989) and the pertinent portions thereof are summarized in the table below.

| Kinds of Additives | RD17643 | RD18716 | RD308119 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col.–p. 649, right col. | p. 996, right col.–p. 998, right col. |
| 4. Brightening agent | p. 24 | p. 647, right col. | p. 998, right col. |
| 5. Antifoggant, stabilizer | pp. 24–25 | p. 649, right col. | p. 998, right col.–p. 1,000, right col. |
| 6. Light absorbent, filter dye, UV absorbent | pp. 25–26 | p. 649, right col.–p. 650, left col. | p. 1,003, left col.–p. 1,003, right col. |
| 7. Stain inhibitor | p. 25, right col. | p. 650, left to right cols. | p 1,002, right col. |
| 8. Dye Image Stabilizer | p. 25 | | p. 1,002, right col. |
| 9. Hardening agent | p. 26 | p. 651, left col. | 1,004, right col.–p. 1,005, left col. |
| 10. Binder | p. 26 | p. 651, left col. | p. 1,003, right col.–p. 1,004, right col. |
| 11. Plasticizer, lubricant | p. 27 | p. 650, right col. | p. 1,006, left col.–p. 1,006, right col. |
| 12. Coating aid, surface active agent | pp. 26–27 | p. 650, right col. | p. 1,005, left col.–p. 1,006 left col. |
| 13. Antistatic agent | p. 27 | p. 650, right col. | p. 1006, right col.–p. 1,007, left col. |
| 14. Matting agent | | | p. 1,008, left col.–p. 1,009, left col. |

In order to prevent the deterioration in the photographic properties due to the formaldehyde gas, a compound capable reaction with formaldehyde to fix it described in U.S. Pat. Nos. 4,411,987 and 4,435,503 is preferably added to the photographic material.

Various color couplers can be used in the present invention and specific examples thereof are described in patents cited in the above-described *Research Disclosure*, No. 17643, VII-C to G and ibid., No. 307105, VII-C to G.

As the yellow coupler, those described, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and EP-A-249473 are preferred.

Preferred magenta couplers are 5-pyrazolone and pyrazoloazole compounds and those described in U.S. Pat. Nos. 4,310,619 and 4,351,897, European Patent 73636, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and International Patent Application WO88/04795 are particularly preferred.

The cyan coupler includes phenol and naphthol couplers and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199 and JP-A-61-42658 are preferred.

Typical examples of the polymerized dye forming coupler are described in U.S. Pat. Nos. 3,451,820, 4,080,211, 4,367,282, 4,409,320 and 4,576,910, British Patent 2,102,137 and EP-A-341188.

As the coupler which provides a colored dye having an appropriate diffusibility, those described in U.S. Pat. No. 4,366,237, British Patent 2,125,570, European Patent 96570 and West German Patent Application (OLS) No. 3,234,533 are preferred.

As the colored coupler which corrects unnecessary absorption of the colored dye, those described in *Research Disclosure*, No. 17643, Item VII-G, ibid., No. 307105, Item VII-G, U.S. Pat. No. 4,163,670, JP-B-57-39413, U.S. Pat. Nos. 4,004,929 and 4,138,258 and British Patent 1,146,368 are preferred. Also, a coupler which releases a fluorescent dye upon coupling and corrects unnecessary absorption of the colored dye by the fluorescent dye released described in U.S. Pat. No. 4,774,181 and a coupler having as a splitting off group a dye precursor group capable of forming a dye upon reaction with a developing agent described in U.S. Pat. No. 4,777,120 are also preferably used.

Compounds which release a photographically useful residue on coupling are also preferably used in the present invention. Preferred DIR couplers which release a development inhibitor are described in patents cited in the above-described *RD* 17643, Item VII-F and ibid., No. 307105, Item VII-F, JP-A-57-151944, JP-A-57-154234, JP-A-60-184248, JP-A-63-37346, JP-A-63-37350 and U.S. Pat. Nos. 4,248,962 and 4,782,012.

As the coupler which imagewise releases a nucleating agent or a development accelerator at the development, those described in British Patents 2,097,140 and 2,131,188, JP-A-59-157638 and JP-A-59-170840 are preferred. Also, compounds which release a fogging agent, a development accelerator or a silver halide solvent upon redox reaction with an oxidation product of a developing agent described in JP-A-60-107029, JP-A-60-252340, JP-A-1-44940 and JP-A-1-45687 are preferred.

Other compounds which can be used in the photographic material of the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds or DIR redox-releasing redox compounds described in JP-A-60-185950 and JP-A-62-24252, couplers which release a dye capable of recovering the color after being released described in EP-A-173302 and EP-A-313308, couplers which release a bleaching accelerator described in *RD*, No. 11449, ibid., 24241 and JP-A-61-201247, ligand-releasing couplers described in U.S. Pat. No. 4,555,477, couplers which release a leuco dye described in JP-A-63-75747 and couplers which release a fluorescent dye described in U.S. Pat. No. 4,774,181.

The coupler for use in the present invention can be incorporated into the photographic material by various known dispersion methods.

Examples of the high boiling point solvent used in an oil-in-water dispersion method are described, for example, in U.S. Pat. No. 2,322,027.

Specific examples of the high boiling point organic solvent having a boiling point of 175° C. or higher under normal pressure which is used in an oil-in-water dispersion method include phthalic esters (e.g., dibutyl phthalate, dicyclohexyl phthalate, di-2-ethylhexylphthalate, decyl phthalate, bis(2,4-di-tert-amylphenyl) phthalate, bis(2,4-di-tert-amylphenyl) isophthalate, bis(1, 1-diethylpropyl)

phthalate); phosphoric or phosphonic esters (e.g., triphenylphosphate, tricresyl phosphate, 2-ethylhexyldiphenyl phosphate, tricyclohexyl phosphate, tri-2-ethylhexylphosphate, tridodecyl phosphate, tributoxyethyl phosphate, trichloropropyl phosphate, di-2-ethylhexylphenyl phosphonate); benzoic esters (e.g., 2-ethylhexylbenzoate, dodecylbenzoate, 2-ethylhexyl-p-hydroxybenzoate); amides (e.g., N,N-diethyldodecanamido, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributyrate, isostearyl lactate, trioctyl citrate); aniline derivatives (e.g., N,N-dibutyl-2-butoxy-5-tert-octylaniline); and hydrocarbons (e.g., paraffin, dodecylbenzene, diisopropylnaphthalene). As the auxiliary solvent, for example, an organic solvent having a boiling point of about 30° C. or higher, preferably from 50° C. to about 160° C., can be used and typical examples thereof include ethyl acetate, butyl acetate, ethyl propionate, methyl ethyl ketone, cyclohexanone, 2-ethoxyethylacetate and dimethylformamido.

The process and effects of the latex dispersion method and specific examples of the latex for impregnation are described, for example, in U.S. Pat. No. 4,199,363 and West German Patent Application (OLS) Nos. 2,541,274 and 2,541,230.

The color photographic material of the present invention preferably contains various antiseptics and antimolds such as phenetyl alcohol; and 1,2-benzisothiazoline-3-one, n-butyl-p-hydroxybenzoate, phenol, 4-chloro-3,5-dimethylphenol, 2-phenoxyethanol and 2-(4-thiazolyl) benzoimidazole described in JP-A-63-257474, JP-A-62-272248 and JP-A-1-80941.

The present invention can be applied to various color photographic materials and representative examples thereof include a color negative film for general purpose or movies, a color reversal film for slide or television, a color paper, a color positive film and a color reversal paper. The present invention is also particularly preferably used in a film for color duplication.

Suitable supports which can be used in the present invention are described, for example, in the above-described *RD*, No. 17643, p. 28, ibid., No. 18716, p. 647, right column to p. 648, left column and ibid., No. 307105, p. 879.

The photographic material of the present invention has a total thickness of all hydrophilic colloid layers on the side having an emulsion layer of preferably 28 μm or less, more preferably 23 μm or less, still more preferably 18 μm or less and particularly preferably 16 μm or less. The swelling speed $T_{1/2}$ is preferably 30 seconds or less, more preferably 20 seconds or less. The layer thickness as used herein means a layer thickness determined under humidity conditioning (for 2 days) at 25° C. and 55% RH (relative humidity). The swelling speed $T_{1/2}$ can be determined according to the method known in the art. For example, it can be measured using a swellometer of the type described in A. Green et al., *Photographic Science and Engineering*, Vol. 19, No. 2, pp. 124–129. $T_{1/2}$ is defined as the time required to reach a half of the saturated film thickness which corresponds to 90% of the maximum swelled layer thickness achieved in the processing with a color developer at 30° C. for 3 minutes and 15 seconds.

The swelling speed $T_{1/2}$ can be controlled by adding a hardening agent to gelatin as a binder or by changing the aging condition after coating.

In the photographic material of the present invention, a hydrophilic colloid layer (called backing layer) having a total dry thickness of from 2 to 20 μm is preferably provided on the side opposite to the side having an emulsion layer. This backing layer preferably contains, for example, the above-described light absorbents, filter dyes, ultraviolet absorbents, antistatic agents, hardening agents, binders, plasticizers, lubricants, coating aids or surface active agents. This backing layer has a swelling ratio of preferably from 150 to 500%.

The color photographic material according to the present invention can be developed by common methods described in the above-described *RD* No. 17643, pp. 28–29, ibid., No. 18716, p. 651, from left to right columns and ibid., No. 307105, pp. 880–881.

The color developer used in the development of a photographic material of the present invention is preferably an alkaline aqueous solution comprising as a main component an aromatic primary amine color developing agent. As the color developing agent, an aminophenol-based compound may be useful but a p-phenylenediamine-based compound is preferred and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and a sulfate, a hydrochloride and a p-toluenesulfonate of these. Among these, particularly preferred is a sulfate of 3-methyl-4-amino-N-ethyl-N-β-hydroxyethylaniline. These compounds can be used in combination of two or more depending on the purpose.

The color developer usually contains a pH buffering agent such as a carbonate, a borate or a phosphate of an alkali metal or a development inhibitor or an antifoggant such as a chloride, a bromide, an iodide, a benzimidazole, a benzothiazole or a mercapto compound. The color developer may also contain, if desired, a preservative such as hydroxyamine, diethylhydroxylamine, sulfite, hydrazines, e.g., N,N-biscarboxymethylhydrazine, phenylsemicarbazides, triethanolamine and catecholsulfonic acids; an organic solvent such as ethylene glycol and diethylene glycol; a development accelerator such as benzyl alcohol, polyethylene glycol, a quaternary ammonium salt and amines; a dye-forming coupler; a competing coupler; an auxiliary developing agent such as 1-phenyl-3-pyrazolidone; a tackifying agent; and various chelating agents including aminopolycarboxylic acid, aminopolyphosphonic acid, alkylphosphonic acid and phosphonocarboxylic acid. Representative examples of the chelating agent include ethylenediaminetetraacetic acid, nitriletriacetic acid, diethylenetriaminepentaacetic acid, cyclohexanediaminetetraacetic acid, hydroxyethyliminodiacetic acid, 1-hydroxyethylidene-1,1-diphosphonicacid, nitrilo-N,N,N-trimethylenephosphonic acid, ethylenediamine-N,N,N,N-tetra-methylenephosphonic acid, ethylenediamine-di(o-hydroxyphenylacetic acid) and a salt thereof.

In carrying out reversal processing, the color development usually follows black-and-white development. The black-and-white developer uses known black-and-white developing agents such as dihydoxybenzenes, e.g., hydroquinone, 3-pyrazolidones, e.g., 1-phenyl-3-pyrazolidone, and aminophenols, e.g., N-methyl-p-aminophenols, individually or in combination. The color developer or the black-and-white developer usually has a pH of from 9 to 12. The replenishing amount of these developers is, although it may vary depending on the color photographic material processed, generally 3 l or less per $m^2$ of the photographic material and when the bromide ion concentration of the replenisher is lowered, the replenishing amount may be reduced to 500 ml or less. When the replenishing amount is reduced, the contact area of the processing solution with air is preferably reduced to prevent the evaporation or air oxidation of the solution.

The contact area of the photographic processing solution with air in a processing tank can be expressed by an opening ratio defined as follows:

Opening ratio=[contact area of the processing solution with air ($cm^2$)]÷[volume of the processing solution ($cm^3$)].

The opening ratio as defined above is preferably 0.1 or less, more preferably from 0.001 to 0.05. The opening ratio can be reduced, for example, by providing a shielding material such as a floating lid on the surface of the photographic processing solution in the processing tank, by using a movable lid described in JP-A-1-82033 or by a slit development method described in JP-A-63-216050. The reduction in opening ratio is preferably applied not only to color development and black-and-white development but also to any subsequent step such as bleaching, bleach-fixing, fixing, water washing or stabilization. Further, by using a means for suppressing the accumulation of bromide ions in the developer, the replenishing amount can be reduced.

The color development time is usually set to from 2 to 5 minutes, however, further reduction in the processing time can be achieved by carrying out the processing at high temperature and high pH and by using a color developing agent in a high concentration.

After the color development, the photographic emulsion layer is usually subjected to bleaching. The bleaching may be conducted at the same time with the fixing (bleach-fixing) or may be conducted separately. For the purpose of rapid processing, the bleaching may be followed by bleach-fixing. Further, a processing in a bleach-fixing bath consisting of two continuous tanks, a processing comprising fixing before bleach-fixing or a processing comprising bleaching after bleach-fixing may be freely selected depending upon the purpose. Examples of the bleaching agent include compounds of a polyvalent metal such as iron(III), peracids (particularly, sodium persulfate is suitable for movie color negative film), quinones and nitro compounds. Representative examples of the bleaching agent include organic complex salts of iron(III), e.g., complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, or complex salts, for example, with citric acid, tartaric acid or malic acid. Among these, an aminopolycarboxylic acid ferrate complex salt including an ethylenediaminetetraacetato Ferrate complex salt and 1,3-diaminopropanetetraacetato ferrate complex salt is preferred in view of rapid processing and environmental conservation. Further, the aminopolycarboxylic acid ferrate complex salt is particularly useful either for the bleaching solution or for bleach-fixing monobath. The bleaching solution or the bleach-fixing solution using the aminopolycarboxylic acid ferrate complex salt has a pH of generally from 4.0 to 8 but the processing may be carried out at a lower pH for expediting the processing.

A bleaching accelerator may be used, if desired, in the bleaching solution, the bleach-fixing solution or a prebath thereof. Specific examples of useful bleaching accelerators include compounds described in the following specifications: for example, compounds having a mercapto group or a disulfide group described in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426 and *Research Disclosure*, No. 17129 (July, 1978); thiazolidine derivatives described in JP-A-51-140129; thiourea derivatives described in JP-B-45-8506, JP-A-52-20832, JP-A-53-32735 and U.S. Pat. No. 3,706,561; iodide salts described in West German Patent 1,127,715 and JP-A-58-16235; polyoxyethylene compounds described in West German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ions. Among these, compounds having a mercapto group or a disulfide group are preferred in view of a large acceleration effect and in particular, compounds described in U.S. Pat. No. 3,893,858, West German Patent No. 1,290,812 and JP-A-53-95630 are preferred. Also, compounds described in U.S. Pat. No. 4,552,884 are preferred. The bleaching accelerator may be incorporated into the photographic material. The bleaching accelerator is particularly useful in bleach-fixing a color photographic material for photographing.

In addition to the above-described compounds, the bleaching solution or the bleach-fixing solution preferably contains an organic acid in order to prevent bleaching stain. Particularly preferred organic acid is a compound having an acid dissociation constant (pKa) of from 2 to 5 and specific examples thereof include acetic acid, propionic acid and hydroxyacetic acid.

Examples of the fixing agent for use in the fixing solution or the bleach-fixing solution include thiosulfates, thiocyanates, thioether-based compounds, thioureas and a large quantity of iodides. Among these, a thiosulfate is commonly used and an ammonium thiosulfate can be most widely used. Also, a combination use of the thiosulfate with a thiocyanate, thioether-based compound or a thiourea is preferred. As the preservative for the fixing solution or the bleach-fixing solution, sulfites, bisulfites, carbonyl bisulfite adducts and sulfinic acid compounds described in EP-A-294769 are preferred. Further, the fixing solution or the bleach-fixing solution preferably contains various aminopolycarboxylic acids or organic phosphonic acids for the purpose of stabilization of the solution.

In the present invention, in order to adjust the pH, a compound having a pKa of from 6.0 to 9.0, preferably, an imidazole such as imidazole, 1-methylimidazole, 1-ethylimidazole and 2-methylimidazole is preferably added to the fixing solution or the bleach-fixing solution in an amount of from 0.1 to 10 mol/liter.

The total time of desilvering is preferably as short as possible if desilvering failure is not caused. The time is preferably from 1 to 3 minutes, more preferably from 1 to 2 minutes. The processing temperature is from 25 to 50° C., preferably from 35 to 45° C. In this preferred temperature range, the desilvering rate is improved and the occurrence of stains after processing can be effectively prevented.

In the desilverization, the stirring is preferably intensified as highly as possible. Specific examples of the method for intensifying stirring include a method comprising colliding a jet stream of a processing solution against the emulsion surface of the photographic material described in JP-A-62-183460, a method for increasing the stirring effect using a rotary means described in JP-A-62-183461, a method for increasing the stirring effect by moving the photographic material while putting the emulsion surface into contact with a wire blade provided in the solution to cause turbulence on the emulsion surface, and a method for increasing the circulative flow rate of the entire processing solutions. Such a means for intensifying the stirring is effective in any of the bleaching solution, the bleach-fixing solution or the fixing solution. The intensification of stirring is considered to increase the supply rate of the bleaching agent or the fixing agent into the emulsion layer and as a result, to elevate the desilverization rate. The above-described means for intensifying stirring is more effective when a bleaching accelerator is used and in this case, the acceleration effect can be outstandingly increased or the inhibition of fixing can be eliminated by the bleaching accelerator.

The automatic developing machine used for the development of the photographic material of the present invention preferably has a transportation means of a photographic material described in JP-A-60-191257, JP-A-60-191258 and JP-A-60-191259. As described in JP-A-60-191257 above, the transportation means can extremely decrease the amount of a processing solution carried over from a previous bath to a post bath and provides a great effect in preventing the deterioration in capacity of the processing solution. Such an effect is particularly useful in reducing the processing time or decreasing the replenishing amount of a processing solution in each step.

The silver halide color photographic material of the present invention is generally subjected to water washing and/or stabilization after the desilvering. The amount of water in the water washing can be set over a wide range according to the characteristics (e.g., due to the material used such as a coupler) or the use of the photographic material and in addition, the temperature of washing water, the number of water washing tanks (stage number), the replenishing system such as countercurrent and co-current or other various conditions. Among these, the relation between the number of water washing tanks and the amount of water in a multi-stage countercurrent system can be obtained according to the method described in *Journal of the Society of Motion Picture and Television Engineers*, Vol. 64, pp. 248–253 (May, 1955).

According to the multi-stage countercurrent system described in the above-described publication, the amount of washing water may be greatly reduced but due to the increase in the residence time of water in the tank, a problem is caused such that bacteria proliferate and the floats generated adhere to the photographic material. In the processing of a color photographic material of the present invention, in order to solve such a problem, a method for reducing calcium ions or magnesium ions described in JP-A-62-288838 can be very effectively used. Further, for example, isothiazolone compounds and thiabendazoles described in JP-A-57-8542, chlorine-based germicides such as sodium chlorinated isocyanurate or germicides such as benzotriazole described in Hiroshi Horiguchi, *Bokin, Bobai-Zai no Kagaku*, Sankyo Shuppan (1986), *Biseibutsu no Mekkin, Sakkin, Bobai-Gijutsu* compiled by Eisei Gijutsu Kai, issued by Kogyo Gijutsu Kai (1982), and *Bokin-Bobai Zai Jiten* compiled by Nippon Bokin Bobai Gakkai (1986) can be also used.

The washing water in the processing of the photographic material of the present invention has a pH of from 4 to 9, preferably from 5 to 8. The temperature of the washing water and the processing time of water washing may be established variously according to the characteristics and use of the photographic material used but commonly they are from 15 to 45° C. and from 20 seconds to 10 minutes, preferably from 25 to 40° C. and from 30 seconds to 5 minutes, respectively. The photographic material of the present invention can be processed directly by a stabilizing solution in place of the above-described water washing. In such a stabilization processing, any known methods described in JP-A-57-8543, JP-A-58-14834 and JP-A-60-220345 can be used.

In some cases, the stabilization processing may be further carried out after the above-described water washing. An example thereof is a stabilization bath containing a dye stabilizing agent and a surface active agent used as a final bath of a color photographic material for photographing. Examples of the dye stabilizing agent include aldehydes such as formalin and glutaraldehyde, N-methylol compounds and hexamethylenetetramine or aldehyde sulfite addition products. This stabilization bath may also contain various chelating agent and antimolds.

The overflow solution accompanying the replenishing of the above-described washing water and/or stabilization solution can be re-used in other processing steps such as desilvering.

In the processing, for example, using an automatic developing machine, if the above-described respective processing solutions are concentrated due to evaporation, water is preferably added to correct the concentration.

A color developing agent may be incorporated into the silver halide color photographic material of the present invention so as to simplify and expedite the processing. The color developing agent is preferably incorporated into the photographic material in the form of a precursor of various type. Examples of the precursor include indoaniline compounds described in U.S. Pat. No. 3,342,597, Schiff base-type compounds described in U.S. Pat. No. 3,342,599, *Research Disclosure* No. 14850 and ibid. No. 15159, aldol compounds described in ibid. No. 13924, metal salt complexes described in U.S. Pat. No. 3,719,492 and urethane-based compounds described in JP-A-53-135628.

The silver halide color photographic of the present invention may contain, if desired, various 1-phenyl-3-pyrazolidones for the purpose of accelerating the color development. Typical examples of the compound are described in JP-A-56-64339, JP-A-57-144547 and JP-A-58-115438.

In the present invention, each processing solution is used at a temperature of from 10 to 50° C. Usually, the normal temperature is from 33 to 38° C. but higher temperatures may be used to accelerate the processing to thereby shorten the processing time or on the contrary, lower temperatures may be used to achieve improved image quality or improved stability of the processing solution.

The silver halide photographic material of the present invention can also be applied to a heat developable photographic material described in U.S. Pat. No. 4,500,626, JP-A-60-133449, JP-A-59-218443, JP-A-61-238056 and EP-A-210660.

Further, when the silver halide color photographic material of the present invention is applied to a film unit with a lens described in JP-B-2-32615 and JP-B-U-3-39784 (the term "JP-B-U" as used herein means an "examined Japanese utility model publication"), the effect is more readily exerted and the use thereof is effective.

The present invention is described below in greater detail with reference to examples, but the present invention should not be construed as being limited to these examples.

EXAMPLE 1

(1) Preparation of Emulsion

Preparation of Emulsion 1-A (grain size: 0.40 μm)

(1-1) Grain Formation 69.7 ml of an aqueous silver nitrate solution (containing 17.1 g of $AgNO_3$ in 100 ml) and 69.7 ml of an aqueous potassium halide solution (containing 11.3 g of KBr and 0.52 g of KI in 100 ml) were added simultaneously by a double jet method while stirring to 1.4 l of an aqueous solution at 40° C. containing 2.1 g of KBr and 7.6 g of gelatin over 45 seconds. After raising the temperature to 58° C., an aqueous gelatin solution (containing 35 g of gelatin and 284 ml of water) was added to effect ripening for 30 minutes.

Subsequently, Aqueous Silver Nitrate Solution (A) (containing 72.8 g of silver nitrate) and Aqueous Potassium Bromide Solution (C) were added over 20 minutes. At this time, the pAg was kept at 9.0.

After lowering the temperature to 40° C., a silver nitrate solution (containing 8.4 g of silver nitrate) and an aqueous potassium iodide solution (containing 8.3 g of potassium iodide) were added by a double jet method and then, Aqueous Silver Nitrate Solution (B) (containing 148.9 g of silver nitrate) and an aqueous potassium bromide solution were added while keeping the pAg at 7.5. Thereafter, the resulting mixed solution was cooled to 35° C. and washed with water by normal flocculation method, and after adding thereto 78 g of gelatin, the pH and the pAg were adjusted to 6.2 and 8.8, respectively.

The resulting emulsion comprised a tabular grain having an average circle-corresponding diameter of 0.53 μm and an aspect ratio of 3.5 (sphere-corresponding diameter of 0.4 μm).

(1-2) Spectral Sensitization and Chemical Sensitization

After raising the temperature of the emulsion to 64° C., $4.4\times10^{-4}$ mol/mol-Ag of Sensitizing Dye Exs-1, $1.3\times10^{-5}$ mol/mol-Ag of Sensitizing Dye Exs-2 and $4.4\times10^{-4}$ mol/mol-Ag of Sensitizing Dye Exs-3 were added to the emulsion and allowed to stand for 10 minutes and then, $3.0\times10^{-5}$ mol/mol-Ag of sodium thiosulfate, $2.7\times10^{-3}$ mol/mol-Ag of potassium thiocyanate and $6.1\times10^{-6}$ mol/mol-Ag of chloroauric acid were added thereto to effect ripening so that the sensitivity upon exposure for 1/100 second could be highest. The thus obtained emulsion was designated as Emulsion 1-A.

Preparation of Emulsions 1-B to 1-E

Emulsions 1-B to 1-E shown in Table 1 were prepared in the same manner as for Emulsion 1-A except for changing the ratio of Aqueous Silver Nitrate Solution (A) to Aqueous Silver Nitrate Solution (B) and the growth potential. Each of these emulsions was subjected to optimal spectral sensitization and chemical sensitization in the same manner as Emulsion 1-A.

Preparation of Emulsion 2-A

Emulsion 2-A was prepared by carrying out the grain formation in the same manner as in Emulsion 1-A until the lowering of the temperature to 40° C.

Subsequently, after adding 19.4 g of an aqueous solution of sodium p-iodoacetamidobenzenesulfonate, 77 ml of 0.80 M aqueous sodium sulfite solution and then an aqueous NaOH solution were added and the pH was raised to 9.0, kept for 8 minutes to abruptly produce iodide ions and returned to 5.0. The time until 50% of sodium p-iodoacetamidobenzenesulfonate completed the release of iodide ions was 10 seconds (counted from the moment when the pH was raised to 9.0). Thereafter, the same procedure as that after lowering of the temperature to 40° C. in the preparation of Emulsion 1-A was performed. The resulting emulsion comprised tabular grains having an average circle-corresponding diameter of 0.4 μm and an aspect ratio of 3.5.

Preparation of Emulsions 2-B to 2-E

Emulsions 2-B to 2-E shown in Table 1 were prepared in the same manner as for Emulsion 2-A except for changing the ratio of Aqueous Silver Nitrate Solution (A) to Aqueous Silver Nitrate Solution (B) and the growth potential. Each of these emulsions was subjected to optimal spectral sensitization and chemical sensitization in the same manner as Emulsion 1-A.

TABLE 1

| Emulsion | Sphere-Corresponding Diameter (μm) | Circle-Corresponding Diameter (μm) | Aspect Ratio | Dislocation Line-Integrated Site (%) | Number of Dislocation Lines | Use of Iodide Ion-Releasing Agent | Remarks |
|---|---|---|---|---|---|---|---|
| 1-A | 0.4 | 0.53 | 3.5 | 15 | 10 lines or more | none | Comparison |
| 1-B | " | " | " | 25 | 10 line or more | " | Invention |
| 1-C | " | " | " | 35 | 10 lines or more | " | " |
| 1-D | " | " | " | 45 | 10 lines or more | " | " |
| 1-E | " | " | " | 55 | 10 lines or more | " | Comparison |
| 2-A | " | " | " | 15 | 10 lines or more | used | " |
| 2-B | " | " | " | 25 | 10 lines or more | " | Invention |
| 2-C | " | " | " | 35 | 10 lines or more | " | " |
| 2-D | " | " | " | 45 | 10 lines or more | " | " |
| 2-E | " | " | " | 55 | 10 lines or more | " | Comparison |

(2) Preparation of Coated Sample and Evaluation Thereof

Samples 101 to 110 were prepared by coating each of emulsions shown in Table 1 and a protective layer on a cellulose triacetate film support having provided thereon an undercoat layer in an amount as shown in Table A.

TABLE A

| Condition for Coating Emulsion | |
|---|---|
| (1) Emulsion Layer | |
| • Emulsion (prepared above) as silver | $3.6 \times 10^{-2}$ mol/m$^2$ |
| • Coupler | $1.5 \times 10^{-3}$ mol/m$^2$ |

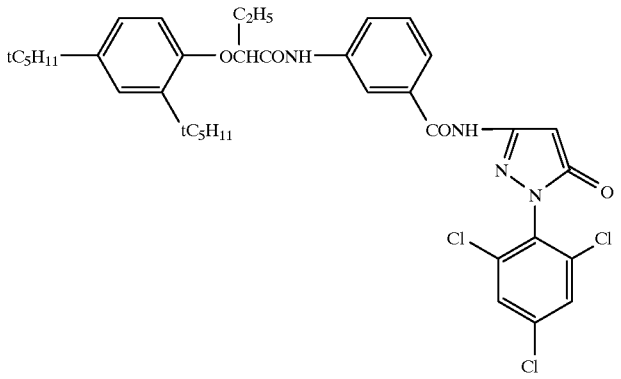

| | |
|---|---|
| • Tricresyl phosphate | 1.10 g/m$^2$ |
| • Gelatin | 2.30 g/m$^2$ |
| (2) Protective Layer | |
| • 2,4-Dichloro-6-hydroxy-s-triazine sodium salt | 0.08 g/m$^2$ |
| • Gelatin | 1.80 g/m$^2$ |

Each of the emulsions was left at 40° C. in a condition of 70% RH (relative humidity) for 14 hours, then exposed through a continuous wedge for 1/100 second and subjected to color development shown in Table B below.

Each of the processed samples was determined on the density through a green filter.

TABLE B

| Step | Processing Time | Processing Temperature (° C.) |
|---|---|---|
| Color development | 2 min. 00 sec. | 40 |
| Bleach-fixing | 3 min. 00 sec. | 40 |
| Water washing (1) | 20 sec. | 35 |
| Water washing (2) | 20 sec. | 35 |
| Stabilization | 20 sec. | 35 |
| Drying | 50 sec. | 65 |

Each processing solution had the following composition.

| (Color Developer) | (unit: g) |
|---|---|
| Diethylenetriaminepentaacetic acid | 2.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make | 1.0 liter |
| pH | 10.05 |

TABLE B-continued

| (Bleach-fixing Solution) | (unit: g) |
|---|---|
| Ammonium ethylenediaminetetraacetato ferrate dihydrate | 90.0 |
| Sodium ethylenediaminetetraacetate | 5.0 |
| Ammonium sulfite | 12.0 |
| Aqueous solution of ammonium thiosulfate (70%) | 260.0 ml |
| Acetic acid (98%) | 50 ml |
| Bleaching accelerator | 0.01 mol |

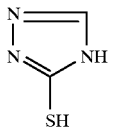

| | |
|---|---|
| Water to make | 1.0 liter |
| pH | 6.0 |

(Washing Water)

Tap water was passed through a mixed bed column filled with an H-type strongly acidic cation exchange resin (Amberlite IR-120B, produced by Rhom & Haas) and an OH-type anion exchange resin (Amberlite IR-400, produced by the same company) to reduce the calcium and magnesium ion concentration to 3 mg/liter or less and then thereto 20 mg/liter of TABLE B-continued

| | |
|---|---|
| dichlorinated sodium isocyanurate and 1.5 g/liter of sodium sulfate were added. The resulting solution had a pH of from 6.5 to 7.5. | |
| (Stabilizer) | (unit: g) |
| Formalin (37%) | 2.0 ml |
| Polyoxyethylene-p-monononylphenyl ether (average polymerization degree: 10) | 0.3 |
| Ethylenediaminetetraacetate disodium salt | 0.05 |
| Water to make | 1.0 liter |
| pH | 5.0–8.0 |

Each of the processed samples was determined on the density through a green filter. From the results of this measurement, the sensitivity and the fog value of each sample were obtained. The sensitivity is shown by a relative value to the reciprocal of the exposure amount giving the density of fog+0.2. The gradation was obtained from the gradient formed by connecting a point giving the density of 1 and the point giving the density of 2 on the characteristic curve with the abscissa being a logarithm of the exposure amount. Further, an excessive exposure was applied to obtain the maximum coloring density. The results obtained are shown in Table 2.

TABLE 2

| Sample | Emulsion | Sensitivity | Gradation | Remarks |
|---|---|---|---|---|
| 101 | 1-A | 100 | 100 | Comparison |
| 102 | 1-B | 130 | 190 | Invention |
| 103 | 1-C | 145 | 210 | " |
| 104 | 1-D | 140 | 200 | " |
| 105 | 1-E | 95 | 80 | Comparison |
| 106 | 2-A | 105 | 105 | " |
| 107 | 2-B | 150 | 190 | Invention |
| 108 | 2-C | 165 | 210 | " |
| 109 | 2-D | 160 | 200 | " |
| 110 | 2-E | 100 | 85 | Comparison |

In Table 2, the sensitivity of each of Samples 102 to 110 is shown by a relative value to the sensitivity of Sample 101 taken as 100.

Among Samples 101 to 105, Samples 102, 103 and 104 having a dislocation-integrated site according to the present invention exhibited very large increase in the sensitivity and very high intensity in the hard gradation as compared with Comparative Sample 101 or 105, thus, the effect of the present invention is conspicuous.

Also, among Samples 106 to 110 using an iodide ion-releasing agent, Samples 107, 108 and 109 according to the present invention exhibited very excellent results with respect to the sensitivity and the gradation.

On the other hand, the effect owing to the use of an iodide ion-releasing agent can be examined by comparing, for example, Sample 101 with Sample 106 or Sample 103 with Sample 108. Sample 106 outside the scope of the present invention exhibited an effect to a certain degree resulting from the use of an iodide ion-releasing agent as compared with Sample 101, however, the increase in the sensitivity seen on comparison between Sample 108 using an iodide ion-releasing agent and Sample 103 is greater than the increase seen between Sample 106 and Sample 101. This reveals that the use of an iodide ion-releasing agent at the dislocation-integrating site according to the present invention provides a peculiar effect.

EXAMPLE 2

(1) Preparation of Emulsions 3-A to 3-D

An aqueous solution of 14% potassium bromide and an aqueous solution of 2.0% silver nitrate were added by a double jet method to an aqueous solution obtained by dissolving 6 g of potassium bromide and 25 g of an inactive gelatin having an average molecular weight of 15,000 into 3.7 l of distilled water, while thoroughly stirring at a constant flow rate over 1 minute at 55° C. and at a pBr of 1.0 (2.4% of the total silver amount was consumed at this addition stage).

An aqueous gelatin solution (17%, 300 ml) was added thereto and stirred at 55° C., and then an aqueous solution of 20% silver nitrate was added at a constant flow rate until the pBr reached 2.4 (5.0% of the total silver amount was consumed at this addition stage). Further, a 20% potassium iodobromide solution ($KBr_{1-x}I_x$; X=0.04) and Aqueous Solution (A) of 33% silver nitrate were added by a double jet method over 43 minutes (50% of the total silver amount was consumed at this addition stage). Furthermore, an aqueous solution containing 8.3 g of potassium iodide was added and then a 20% potassium bromide solution and Aqueous Solution (B) of 33% silver nitrate were added by a double jet method over 39 minutes (42.6% of the total silver amount was consumed at this addition stage). The silver nitrate was used in an amount of 425 g in this emulsion. Subsequently, the emulsion was desalted by normal flocculation method and the pAg and the pH were adjusted at 40° C. to 8.2 and 5.8, respectively. Thus, a tabular silver iodobromide emulsin (Em-1) having a circle-corresponding diameter of 1.0 μm, an average aspect ratio of 4.0, a coefficient of variation of 18% and a sphere-corresponding diameter of 0.7 μm was prepared. This emulsion was observed through a 200 kV transmission type electron microscope at the liquid $N_2$ temperature and it was found that 10 or more dislocation lines on average were present per one grain in the vicinity of the outer circumference of the tabular grain.

Emulsions 3-A to 3-D shown in Table 3 were prepared in the same manner as in Example 1.

Each of the emulsions was subjected to optimal chemical sensitization and then to preparation of a coating sample and evaluation in the same manner as in Example 1.

The results obtained are also shown in Table 3.

TABLE 3

| Sample | Emulsion | Sphere-Corresponding Diameter (μm) | Circle-Corresponding Diameter (μm) | Aspect Ratio | Dislocation Integrated Site (%) | Sensitivity | Gradation | Remarks |
|---|---|---|---|---|---|---|---|---|
| 301 | 3-A | 0.7 | 1.0 | 4 | 42 | 100 | 100 | Out of the Invention |
| 302 | 3-B | " | " | " | 62 | 100 | 100 | Out of the Invention |
| 303 | 3-C | " | " | " | 82 | 100 | 100 | Out of the Invention |

TABLE 3-continued

| Sample | Emulsion | Sphere-Corresponding Diameter (μm) | Circle-Corresponding Diameter (μm) | Aspect Ratio | Dislocation Integrated Site (%) | Sensitivity | Gradation | Remarks |
|---|---|---|---|---|---|---|---|---|
| 304 | 3-D | " | " | " | 92 | 100 | 100 | Out of the Invention |

The sensitivity and the gradation each is shown by a relative value to that of Sample 301 taken as 100.

In this Example, a tabular grain having a circle-corresponding diameter out of the present invention was tested. When expression (I) of the present invention is applied to the tabular grain of this Example, the dislocation-integrating site is determined as 82%±15%. However, even if the dislocation-integrating site was varied in the tabular grain having a circle-corresponding diameter out of the present invention, the photographic properties were the same and changes as seen in Example 1 could not be observed. Thus, the present invention specifying the dislocation-integrating site is effective particularly in the small size region where the circle-corresponding diameter is 0.6 μm or less.

EXAMPLE 3

1) Support

The support used in this Example was prepared as follows.

100 Parts by weight of a commercially available polyethylene-2,6-naphthalate polymer and 2 parts by weight of Tinuvin P.326 (produced by Geigy) as an ultraviolet absorbent were dried by a normal method and then melted at 300° C., extruded from a T-die, stretched in the machine direction at 140° C. to 3.0 times, subsequently stretched in the transverse direction at 130° C. to 3.0 times, and further heat fixed at 250° C. for 6 seconds to obtain a PEN film having a thickness of 90 μm.

Further, a part of the resulting film was wound around a stainless-made core having a diameter of 20 cm and imparted by heat history of 110° C. for 48 hours.

2) Coating of Undercoat Layer

Both surfaces of the support obtained above were subjected to corona discharge treatment, UV discharge treatment, glow discharge treatment and flame treatment, and then a coating solution having the following composition was coated on each surface to provide an undercoat layer on the side of high temperature at the time of stretching. The corona discharge treatment was carried out using a solid state corona treatment machine, Model 6KVA, manufactured by Pillar, on the support having a width of 30 cm at a rate of 20 m/min. In this case, from the current and the voltage read out, the subject to be treated was processed at 0.375 KV·A·min/$m^2$. The discharge frequency at the treatment was 9.6 KHz and the gap clearance between the electrode and the dielectric roll was 1.6 mm. The UV discharge treatment was carried out while heating at 75° C. The glow discharge treatment was carried out using a cylindrical electrode under the irradiation at 3,000 W for 30 seconds.

| | | |
|---|---|---|
| Gelatin | 3 | g |
| Distilled water | 25 | ml |
| Sodium α-sulfodi-2-ethylhexylsuccinate | 0.05 | g |
| Formaldehyde | 0.02 | g |
| Salicylic acid | 0.1 | g |
| Diacetyl cellulose | 0.5 | g |
| p-Chlorophenol | 0.5 | g |
| Resorcinol | 0.5 | g |
| Cresol | 0.5 | g |
| $(CH_2{=}CHSO_2CH_2CH_2NHCO)_2CH_2$ | 0.2 | g |
| Trimethylolpropane triazine | 0.2 | g |
| Trimethylolpropane tristoluenediisocyanate | 0.2 | g |
| Methanol | 15 | ml |
| Acetone | 85 | ml |
| Formaldehyde | 0.01 | g |
| Acetic acid | 0.01 | g |
| Concentrated hydrochloric acid | 0.01 | g |

3) Coating of Backing Layer

On one surface of the undercoated support, an antistatic layer, a magnetic recording layer and a slipping layer each having the following composition were provided as the backing layer.

3-1) Coating of Antistatic Layer 3-1-1) Preparation of dispersion solution of electroconductive fine particle (dispersion solution of tin oxide-antimony oxide composite).

230 Parts by weight of a stannic chloride hydrate and 23 parts by weight of antimony trichloride were dissolved into 3,000 parts by weight of ethanol to obtain a uniform solution. To the resulting solution, an aqueous solution of 1N sodium hydroxide was added dropwise until the pH of the above-described solution reached 3 to obtain a coprecipitate of colloidal stannic oxide and antimony oxide. The thus-obtained. coprecipitate was allowed to stand at 50° C. for 24 hours to obtain a red brown colloidal precipitate.

The resulting red brown colloidal precipitate was separated in a centrifugal separator. Then, in order to remove excessive ions, the precipitate was washed with water by adding water thereto in a centrifugal separator. This operation was conducted three times and excessive ions were removed.

200 Parts by weight of the colloidal precipitate after the removal of excessive ions was redispersed in 1,500 parts by weight of water and atomized in a calcining furnace heated at 650° C. to obtain a bluish fine particle powder of tin oxide-antimony oxide composite having an average particle size of 0.005 μm. The resulting fine particle powder had a resistivity of 5 Ω·cm.

A mixed solution of 40 parts by weight of the fine particle powder obtained above and 60 parts by weight of water was adjusted to have a pH of 7.0, rudely dispersed in a stirrer and dispersed in a horizontal sand mill (Dyno-Mill, trade name, manufactured by WILLYA. BACHOFENAG) until the residence time reached 30 minutes. At this time, the secondary agglomerate had an average particle size of about 0.04 μm.

3-1-2) Coating of electroconductive layer

The composition formulated as below was coated to have a dry thickness of 0.2 μm and dried at 115° C. for 60 seconds.

| | |
|---|---|
| Dispersion solution of electro-conductive fine particle prepared in 3-1-1) above | 20 parts by weight |
| Gelatin | 2 parts by weight |
| Water | 27 parts by weight |
| Methanol | 60 parts by weight |
| p-Chlorophenol | 0.5 part by weight |
| Resorcinol | 2 parts by weight |
| Polyoxyethylene nonylphenyl ether | 0.01 part by weight |

The resulting electroconductive layer had a resistance of $10^{8.0}$ Ω (100 V), thus exhibited an excellent antistatic property.

3-2) Coating of Magnetic Recording Layer 1,100 g of a magnetic substance Co-doped γ-$Fe_2O_3$ (acicular, major axis: 0.14 μm, single axis: 0.03 μm, specific surface area: 41 $m^2$/g, saturation magnetization: 89 emu/g, the surface being subjected to surface treatment with 2 wt % of aluminum oxide and 2 wt % of silicon oxide, based on $Fe_2O_3$, coercive force: 930 Oe, $Fe^{+2}/Fe^{+3}$ ratio: 6/94) was mixed with 220 g of water and 150 g of poly(polymerization degree: 16)oxyethylenepropyl trimethoxysilane as a silane coupling agent and well kneaded in an open kneader for 3 hours. The resulting rudely dispersed, viscous solution was dried at 70° C. for a whole day and night to remove water and then treated by heating at 110° C. for 1 hour to obtain surface-treated magnetic particles.

The thus-obtained particles were formulated into the following mixture and the mixture was further kneaded in an open kneader.

| | |
|---|---|
| Surface-treated magnetic particle obtained above | 1,000 g |
| Diacetyl cellulose | 17 g |
| Methyl ethyl ketone | 100 g |
| Cyclohexanone | 100 g |

The resulting kneaded product was further formulated into the following mixture and the mixture was finely dispersed in a sand mill (¼ G) at 200 rpm for 4 hours.

| | |
|---|---|
| Kneaded product obtained above | 100 g |
| Diacetyl cellulose | 60 g |
| Methyl ethyl ketone | 300 g |
| Cyclohexanone | 300 g |

To the resulting dispersion, diacetyl cellulose and 20 wt %, based on the binder, of $C_2H_5C(CH_2OCONHC_6H_3(CH_3)NCO)_3$ as a hardening agent were further added and the resulting solution was diluted with the same amount of methyl ethyl ketone and cyclohexanone so as to have a viscosity of about 80 cp. This solution was coated on the electroconductive layer provided above by a bar coater to have a thickness of 1.2 μm and a magnetic substance coverage of 0.6 g/$m^2$. Further, a silica particle (0.3 μm) as a matting agent and an aluminum oxide (0.5 μm) as an abrasive were added each to give a coverage of 10 mg/$m^2$. The drying was conducted at 115° C. for 6 minutes (the roller in the drying zone and the transportation apparatus all were set at 115° C.).

The increase in the color density of $D^8$ in the magnetic recording layer obtained by using Status M of X-light through a blue filter was about 0.1. The magnetic recording layer had a saturation magnetization moment of 4.2 emu/$m^2$, a coercive force of 923 Oe and an angular ratio of 65%.

3-3) Preparation of Slipping Layer

The solution having the following formulation was coated to give a coating amount of each compound in terms of the solid content as shown below and dried at 110° C. for 5 minutes to provide a slipping layer.

| | |
|---|---|
| Diacetyl cellulose | 25 mg/$m^2$ |
| Compound a: $C_6H_{13}CH(OH)C_{10}H_{20}COOC_{40}H_{81}$ | 6 mg/$m^2$ |
| Compound b: $C_{50}H_{101}O(CH_2CH_2O)_{16}H$ | 9 mg/$m^2$ |

Compound a/Compound b (6:9) were used as a dispersion (average particle size: 0.01 μm) obtained in such a manner that the compounds were dissolved in the same amount of a solution consisting of xylene and propylene glycol monomethyl ether (1:1 by volume) under heating at 105° C., the resulting solution was poured in a 10-folded amount of propylene glycol monomethyl ether (25° C.) to provide a fine dispersion solution, and the resulting solution was diluted with a 5-folded amount of acetone and redispersed in a high-pressure homogenizer (at 200 atm.) to obtain a dispersion. The slipping layer provided as above had excellent properties such that the coefficient of dynamic friction was 0.06 (determined using a stainless steel hard ball having a diameter of 5 mm under a load of 100 g at a speed of 6 cm/minute) and the coefficient of static friction was 0.07 (determined according to clipping method). The slipping property to the emulsion surface, which will be described below, was also good such that the coefficient of dynamic friction was 0.12.

4) Coating of Light-Sensitive Material Layer

On the side of the support opposite to the back layer provided as above, the layers each having the following composition were coated in a superposition manner to provide a color negative photographic film.

In the third layer (low-sensitivity red-sensitive emulsion layer), Emulsions 1-A to 1-E and 2-A to 2-E prepared in Example 1 were added and the samples obtained were designated as Samples 201 to 210, respectively.

(Composition of Light-Sensitive Layer)

Main materials used in each layer are classified as follows:

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective ingredients show coating amounts expressed by the unit g/$m^2$ and in case of silver halide, they show coating amounts in terms of silver. With respect to sensitizing dyes, the coating amount is shown by the unit mol per mol of silver halide in the same layer.

(Sample 201)

| First Layer (antihalation layer) | | |
|---|---|---|
| Black colloidal silver | as silver | 0.09 |
| Gelatin | | 1.60 |
| ExM-1 | | 0.12 |
| ExF-1 | | $2.0 \times 10^{-3}$ |

-continued

| | | |
|---|---|---|
| Solid disperse dye ExF-2 | | 0.030 |
| Solid disperse dye ExF-3 | | 0.040 |
| HBS-1 | | 0.15 |
| HBS-2 | | 0.02 |
| Second Layer (interlayer) | | |
| Silver iodobromide emulsion M | as silver | 0.065 |
| ExC-2 | | 0.04 |
| Polyethylacrylate latex | | 0.20 |
| Gelatin | | 1.04 |
| Third Layer (low-sensitivity red-sensitive emulsion layer) | | |
| Emulsion described in Example 1 | as silver | 0.50 |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| Fourth Layer (medium-sensitivity red-sensitive emulsion layer) | | |
| Silver iodobromide emulsion C | as silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| Fifth Layer (high-sensitivity red-sensitive emulsion layer) | | |
| Silver iodobromide emulsion D | as silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| Sixth Layer (interlayer) | | |
| Cpd-1 | | 0.090 |
| Solid disperse dye ExF-4 | | 0.030 |
| HBS-1 | | 0.050 |
| Polyethylacrylate latex | | 0.15 |
| Gelatin | | 1.10 |
| Seventh Layer (low-sensitivity green-sensitive emulsion layer) | | |
| Silver iodobromide emulsion E | as silver | 0.15 |
| Silver iodobromide emulsion F | as silver | 0.10 |
| Silver iodobromide emulsion G | as silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth Layer (medium-sensitivity green-sensitive emulsion layer) | | |
| Silver iodobromide emulsion H | as silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |

-continued

| | | |
|---|---|---|
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| Ninth Layer (high sensitivity green sensitive emulsion layer) | | |
| Silver iodobromide emulsion I | as silver | 1.25 |
| ExS-4 | | $3.7 \times 10^{-5}$ |
| ExS-5 | | $8.1 \times 10^{-5}$ |
| ExS-6 | | $3.2 \times 10^{-44}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| Tenth Layer (yellow filter layer) | | |
| Yellow colloidal silver | as silver | 0.015 |
| Cpd-1 | | 0.16 |
| Solid disperse dye ExF-5 | | 0.060 |
| Soiid disperse dye ExF-6 | | 0.060 |
| Oil-soluble dye ExF-7 | | 0.010 |
| HBS-1 | | 0.60 |
| Gelatin | | 0.60 |
| Eleventh Layer (low-sensitivity blue-sensitive emulsion layer) | | |
| Silver iodobromide emulsion J | as silver | 0.09 |
| Silver iodobromide emuision K | as silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| Twelfth Layer (high-sensitivity blue-sensitive emulsion layer) | | |
| Silver iodobromide emulsion L | as silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth Layer (first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth Layer (second protective layer) | | |
| Silver iodobromide emulsion M | as silver | 0.10 |
| H-1 | | 0.40 |
| B-1 (diameter: 1.7 $\mu$m) | | $5.0 \times 10^{-2}$ |
| B-2 (diameter: 1.7 $\mu$m) | | 0.15 |
| B-3 | | 0.05 |
| S-1 | | 0.20 |
| Gelatin | | 0.70 |

Futher, in order to provide good preservability, processability, pressure resistance, antimold/fungicidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead salt, gold salt, platinum salt, palladium salt, iridium salt or rhodium salt was appropriately added to each layer.

TABLE 4

| | Average AgI Content (%) | Coefficient of Variation in AgI Content among Grains (%) | Sphere-corresponding Average Grain Size (μm) | Coefficient of Variation in Grain Size (%) | Circle-corresponding Diameter of Projected Area (μm) | Diameter/ Thickness Ratio |
|---|---|---|---|---|---|---|
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 4:

(1) Emulsions J to L were subjected to reduction sensitization at the preparation of the grain using thiourea dioxide and thiosulfonic acid according to the example of JP-A-2-191938 (corresponding to U.S. Pat. No. 5,061,614);

(2) Emulsions C to I were subjected to gold sensitization, sulfur sensitization and selenium sensitization in the presence of the spectral sensitizing dyes described in each light-sensitive layer and sodium thiocyanate according to the example of JP-A-3-237450 (corresponding to EP-A-443453);

(3) in the preparation of tabular grains, a low molecular weight gelatin was used according to the example of JP-A-1-158426;

(4) in tabular grains, dislocation lines as described in JP-A-3-237450 (corresponding to EP-A-443453) were observed through a high-pressure electron microscope;

(5) Emulsion L is a double structured grain having an internal high iodide core described in JP-A-60-143331; and (6) Emulsion M comprises silver iodobromide containing 1 mol % of silver iodide and is a non-sensitized Lippmann emulsion having a grain size of 0.07 μm.

Preparation of Dispersion of Organic Solid Disperse Dye

ExF-2 shown below was dispersed in the following manner. Namely, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured in a 700 ml-volume pot mill, then thereto 5.0 g of Dye ExF-2 and 500 ml of zirconium oxide beads (diameter 1 mm) were added and the mixture was dispersed for 2 hours. The dispersion was conducted using a BO-type vibrating ball mill produced by Chuo Koki K.K. After the dispersion, the content was taken out and added to 8 g of a 12.5% aqueous gelatin solution and beads were removed by filtration to obtain a gelatin dispersion of the dye. The fine dye particles had an average particle size 44 μm.

In the same manner, solid dispersions of ExF-3, ExF-4 and ExF-6 were obtained. The fine dye particles had an age particle size of 0.24 μm, 0.45 μm and 0.52 μm, respectively. ExF-5 was dispersed by the microprecipitation dispersion method described in Example 1 of EP-A-549489 and the average particle size thereof was 0.06 μm.

ExC-1

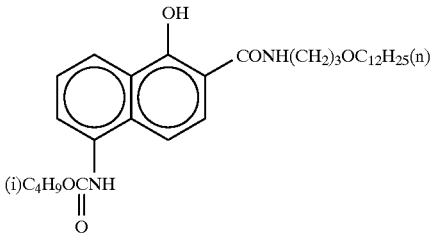

-continued
ExC-2
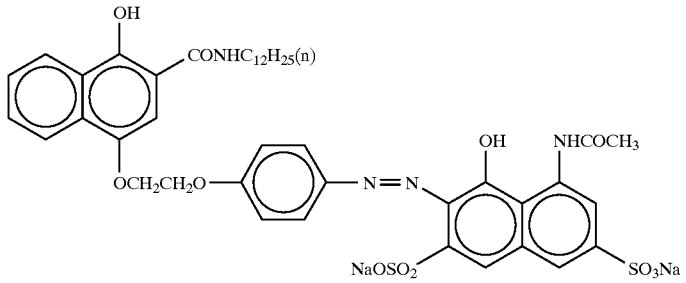
ExC-3
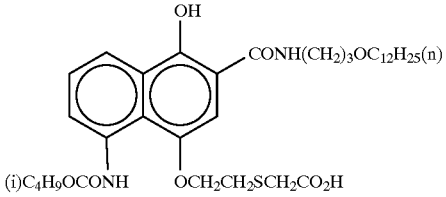
ExC-4
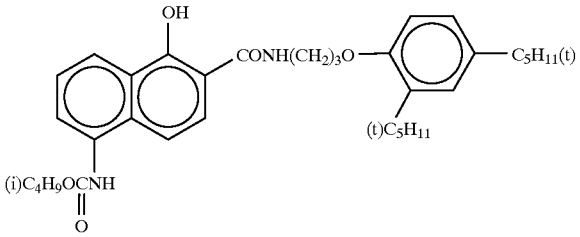
ExC-5
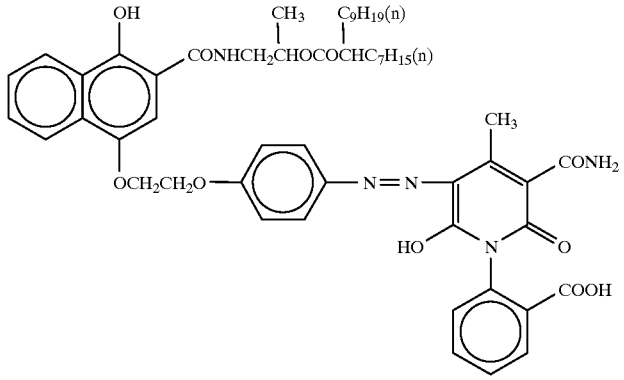
ExC-6
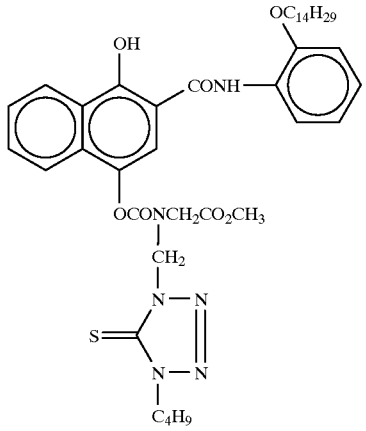

-continued
ExC-7
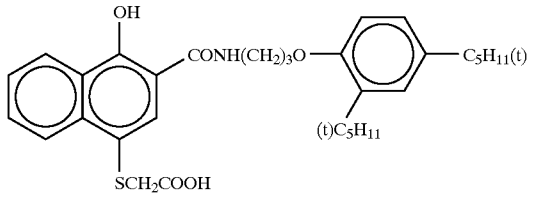
ExC-8
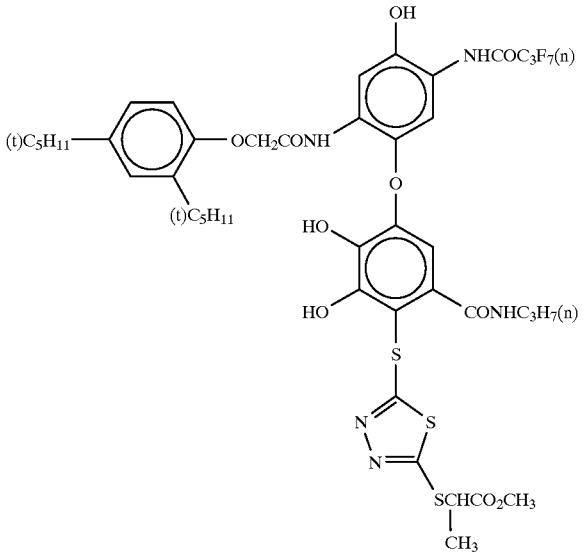
ExM-1
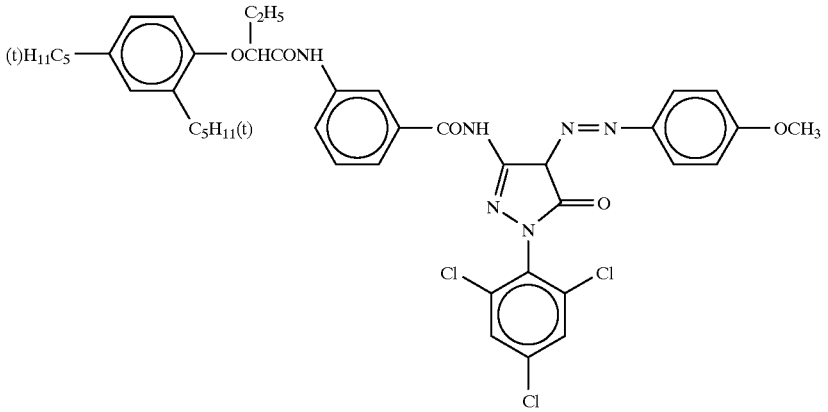
ExM-2
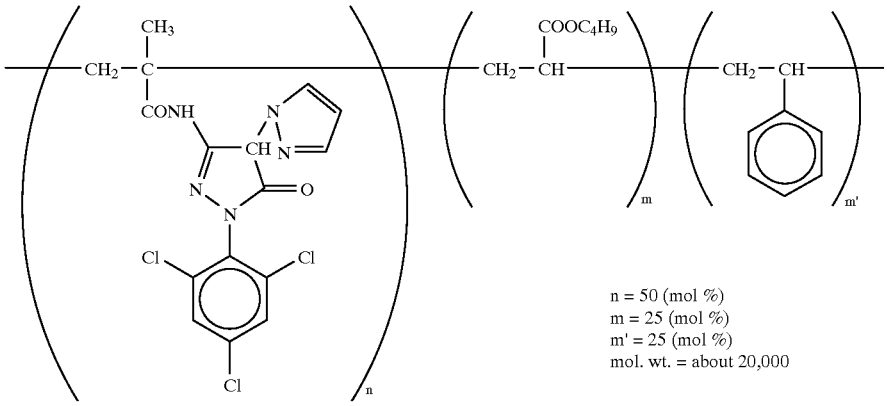
n = 50 (mol %)
m = 25 (mol %)
m' = 25 (mol %)
mol. wt. = about 20,000

-continued
ExM-3
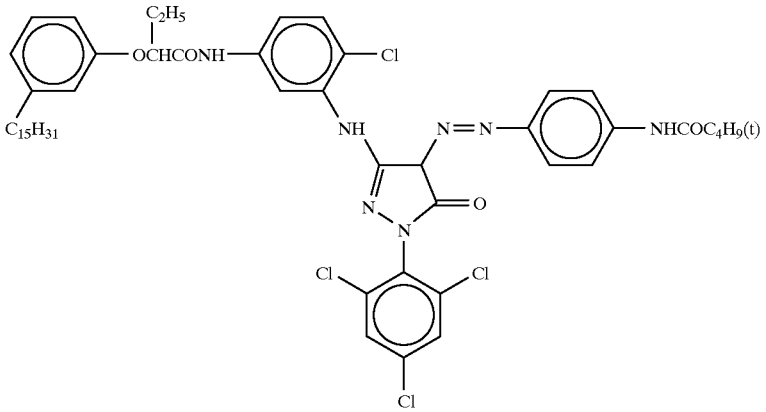
ExM-4
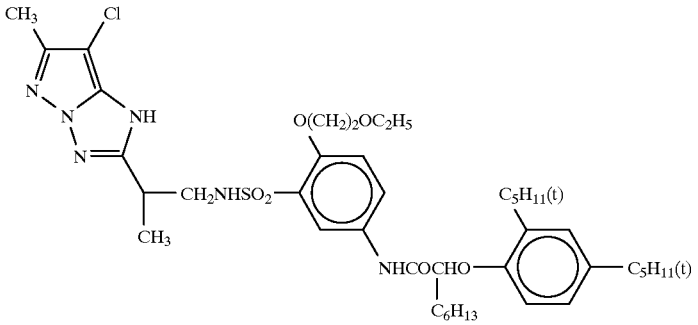
ExM-5
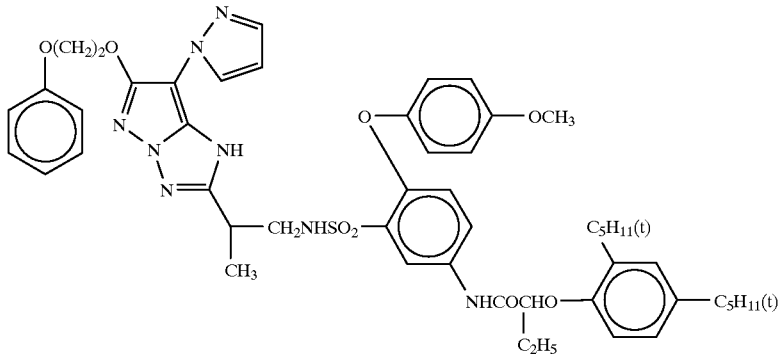
ExY-1
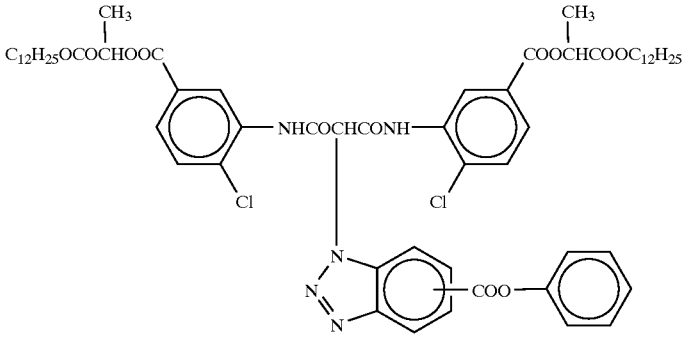

-continued
ExY-2
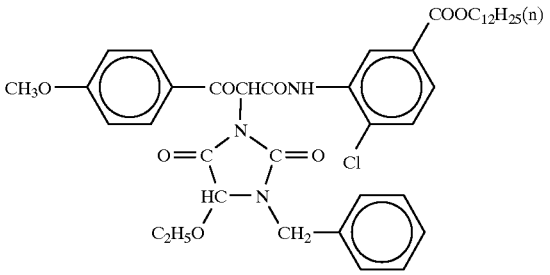
ExY-3
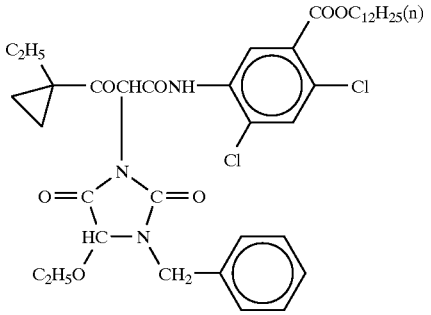
ExY-4
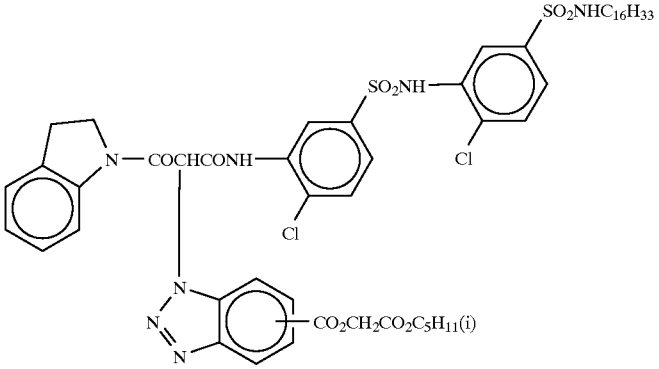
ExY-5
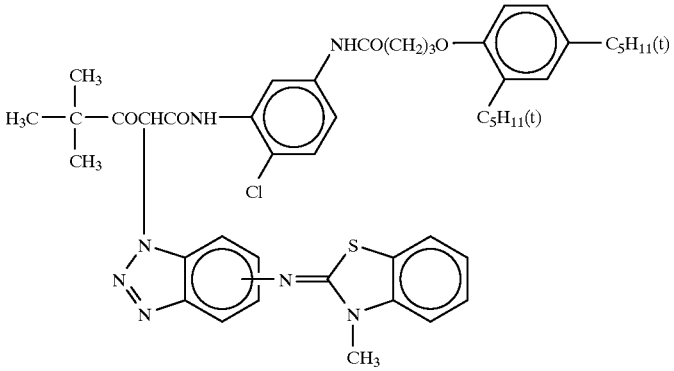
ExF-1
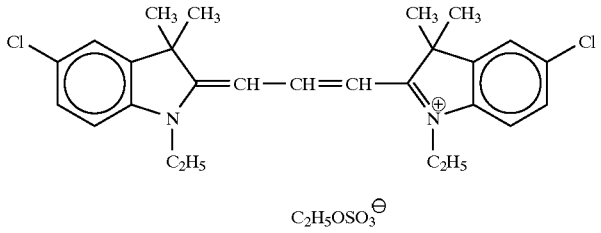

-continued
ExF-2
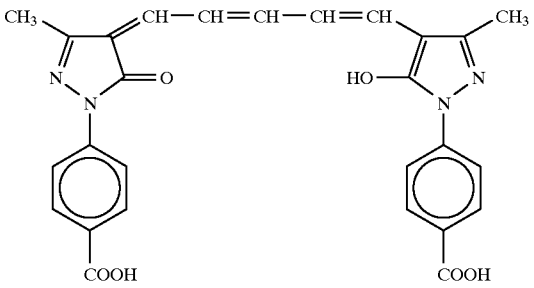
ExF-3
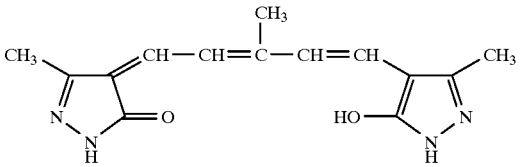
ExF-4
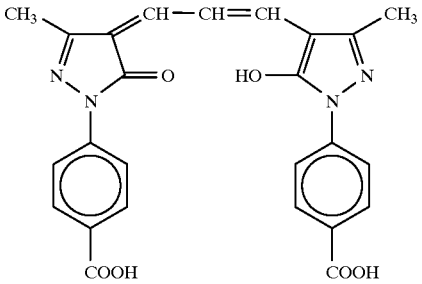
ExF-5
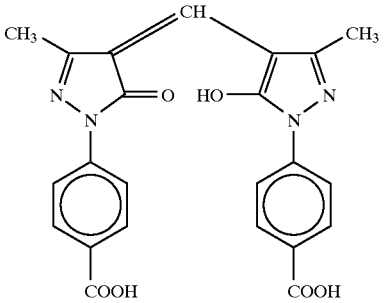
ExF-6
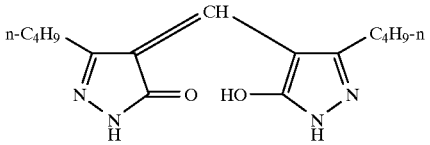
ExF-7
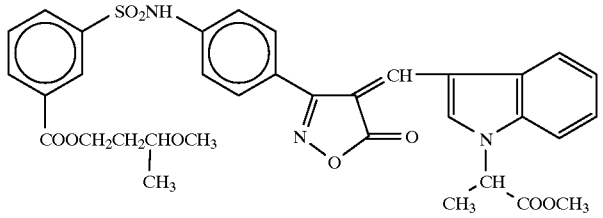

-continued
Cpd-1
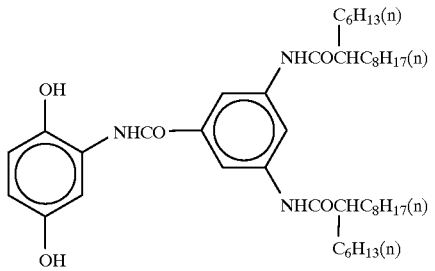
Cpd-2
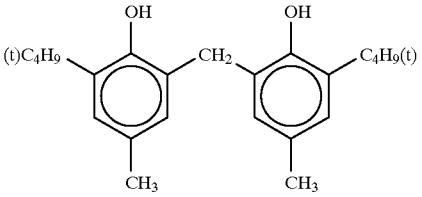
Cpd-3
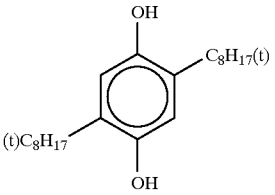
UV-1
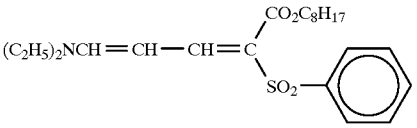
UV-2
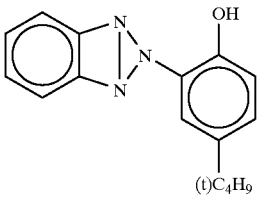
UV-3
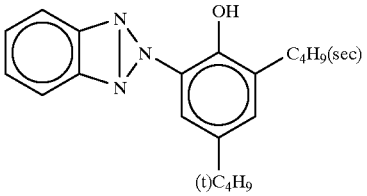
HBS-1
Tricresyl phosphate
HBS-2
Di-n-butyl phthalate
HBS-3
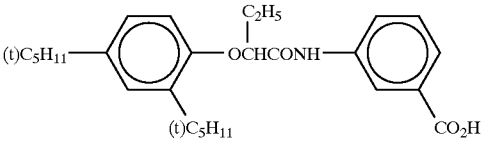
HBS-4
Tri(2-ethylhexyl) phosphate -continued
ExS-1
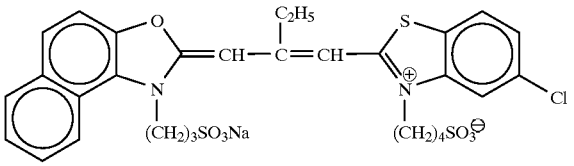
EXS-2
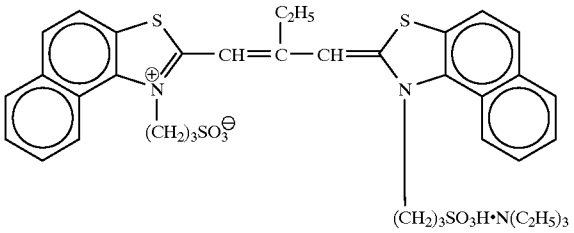
ExS-3
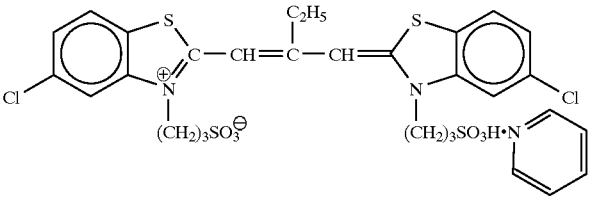
ExS-4
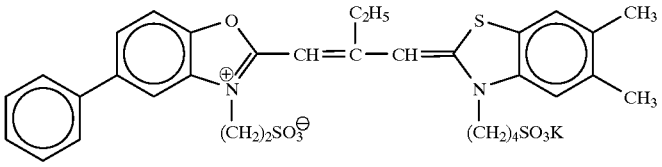
ExS-5
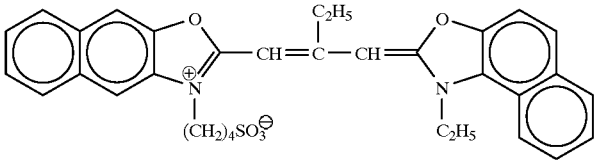
ExS-6
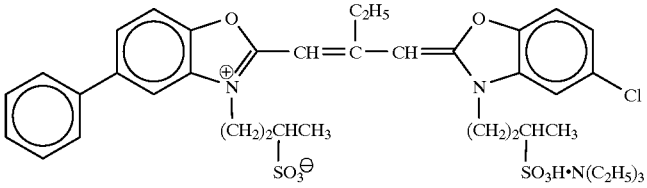
ExS-7
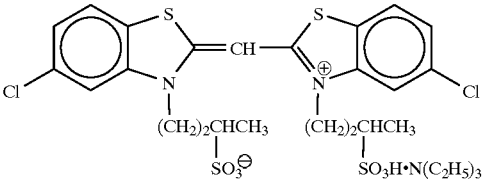
S-1
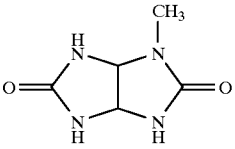

-continued
H-1
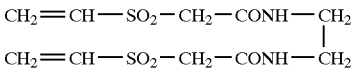
B-1
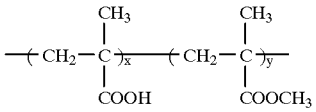
x/y = 10/90 (mol %)
B-2
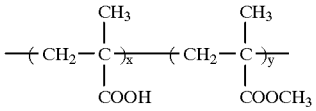
x/y = 40/60 (mol %)
B-3
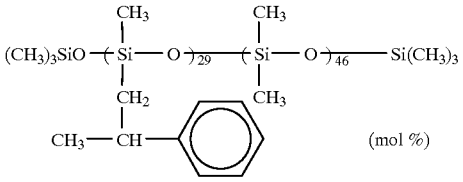
(mol %)
B-4
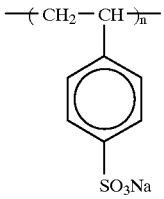
(n = an integer of ca. 1,000)
B-5
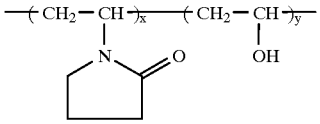
x/y = 70/30 (mol %)
B-6
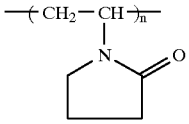
(mol. wt. = about 10,000)
(n = an integer)
W-1
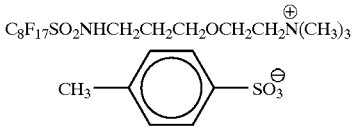
W-2
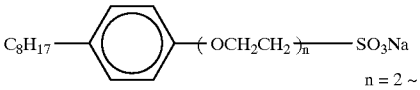
n = 2 ~ 4
W-3
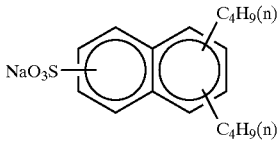
F-1
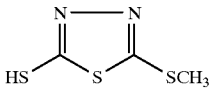

-continued
F-2
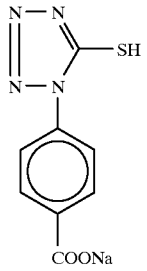
F-3
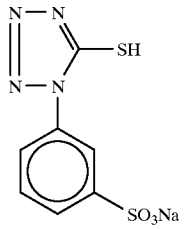
F-4
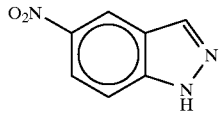
F-5
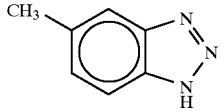
F-6
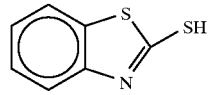
F-7
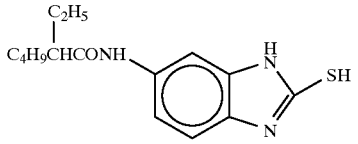
F-8
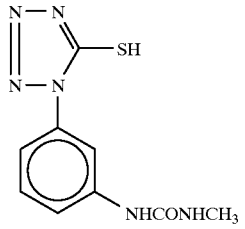
F-9
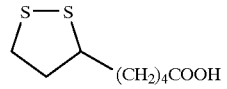
F-10
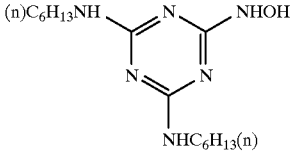

-continued

F-11

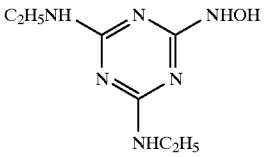

F-12

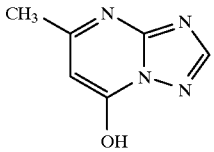

F-13

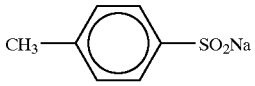

F-14

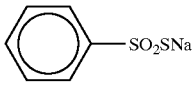

F-15

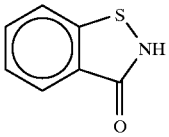

F-16

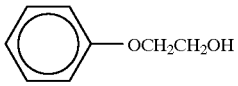

F-17

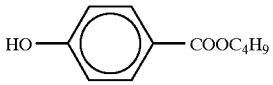

These samples were allowed to stand at 40° C. in the condition of 70% RH for 14 hours and then, each sample was exposed to white light for 1/100 second and color developed in the same manner as in Example 1 except for changing the color development time to 3 minutes and 15 seconds.

Each sample was measured on the density through a red filter and a relative sensitivity was obtained from the reciprocal of the exposure amount giving the density of 1.8 and 2.5. Also, each sample was uniformly exposed to give a density of 1.8 and measured an the granularity.

The granularity was determined after the above-described development processing according to the method described in *The Theory of the Photographic Process*, p. 619 Macmillan.

The results obtained are shown in Table 5. In Table 5, the sensitivity and the granularity of Sample 2 each was taken as 100 and those of other samples are shown as a relative value thereto.

TABLE 5

| Sample | Sensitivity (density: 1.8) | Sensitivity (density: 2.5) | Granularity (density: 1.8) |
|---|---|---|---|
| 201 | 100 | 100 | 100 |
| 202 | 140 | 180 | 105 |
| 203 | 155 | 200 | 110 |
| 204 | 150 | 190 | 110 |
| 205 | 95 | 80 | 85 |
| 206 | 105 | 105 | 100 |
| 207 | 160 | 180 | 104 |
| 208 | 175 | 200 | 110 |
| 209 | 170 | 190 | 109 |
| 210 | 100 | 85 | 80 |

The larger numeral indicates that the sensitivity is higher or the granularity is superior.

It is seen from Table 5 that Samples 202 to 204 and 207 to 209 using the emulsion of the present invention exhibited improved granularity and at the same time, achieved high sensitivity as compared with comparative samples, thus the effect of the present invention is clearly proved.

EXAMPLE 4

(1) Preparation of Emulsion

Preparation of Emulsion 4-A (grain size: 0.23 μm, C/S=25/75, −20 mV shell)

(1) Grain Formation

To 1.6 l of an aqueous solution at 40° C. containing 4.3 g of KBr, 7.5 g of gelatin having an average molecular weight (M) of 20,000, 41 ml of an aqueous silver nitrate solution (containing 20.48 g of silver nitrate in 100 ml) and 41 ml of an aqueous solution of potassium bromide and potassium iodide (containing 14.3 g of potassium bromide and 2.7 g of potassium iodide in 100 ml) were added simultaneously by a double jet method while stirring at a rate of 61.5 ml/min. Then, an aqueous gelatin solution (containing 35.6 g of gelatin and 284 ml of water) was added thereto, then, after raising the temperature to 58° C., an aqueous silver nitrate solution (containing 2.4 g of silver nitrate) was added over 30 seconds and the mixture was ripened for 5 minutes.

Subsequently, Aqueous Silver Nitrate Solution (A) containing 47 g of silver nitrate and an aqueous potassium bromide solution were added over 20 minutes. At this time, the pAg was kept at 8.7.

After lowering the temperature to 40° C., an aqueous silver nitrate solution (containing 8.6 g of silver nitrate) and Aqueous Solution (C) of potassium iodide (8.5 g) were added by a double jet method and then, Aqueous Silver Nitrate Solution (B) containing 164 g of silver nitrate and an aqueous potassium bromide solution were added while keeping the pAg at 9.2. Thereafter, the mixed solution was cooled to 35° C. and washed with water by normal flocculation method, and 77 g of gelatin was added thereto to adjust the pH and the pAg to 6.2 and 8.8, respectively. The resulting emulsion comprised tabular grains having an average circle-corresponding diameter of 0.35 μm, an average thickness of 0.15 μm and an aspect ratio of 2.3.

(2) Spectral Sensitization and Chemical Sensitization

The temperature of the emulsion was raised to 62° C. and thereto $5.5\times10^{-4}$ mol/mol-Ag of Sensitizing Dye ExS-1, $1.6\times10^{-5}$ mol/mol-Ag of Sensitizing Dye ExS-2 and $5.5\times10^{-4}$ mol/mol-Ag of Sensitizer Dye ExS-3 were added. After leaving the mixture for 10 minutes, the emulsion was ripened by adding $2.6\times10^{-5}$ mol/mol-Ag of sodium thiosulfate, $1.1\times10^{-5}$ mol/mol-Ag of N,N-dimethylselenourea, $3.0\times10^{-3}$ mol/mol-Ag of potassium thiocyanate and $8.6\times10^{-6}$ mol/mol-Ag of chloroauric acid so that the sensitivity on the exposure for 1/100 second could be maximal. The thus-obtained emulsion was designated as Emulsion 4-A.

Preparation of Emulsions 4-B to 4-L and 4-P

Emulsions 4-B to 4-L and 4-P as shown in Table 6 were prepared in the same manner as for Emulsion 4-A except for changing the amount of silver nitrate contained in Aqueous Silver Nitrate Solution (A) and Aqueous Silver Nitrate Solution (B), the addition time, the amount of potassium iodide contained in Aqueous Solution (C) and the pAg at the time of adding Aqueous Silver Nitrate Solution (B) and Aqueous Solution (C).

Preparation of Emulsion 4-M

The grain formation was carried out in the same manner as in Emulsion 4-A until the temperature was lowered to 40° C.

Subsequently, after an aqueous solution (19.4 g) of sodium p-iodoacetamidobenzenesulfonate was added, an aqueous solution (77 ml) of 0.80M sodium sulfite and then an aqueous NaOH solution were added and the pH was raised to 9.0, kept for 8 minutes and after abruptly producing iodide ions, returned to 5.0. The time required for 50% of the sodium p-iodoacetamidobenzenesulfonate added to complete the release of iodide ions was 10 seconds (counted from the moment when the pH was raised to 9.0). Thereafter, the same procedure as that after lowering of the temperature to 40° C. in the preparation of Emulsion 4-A was conducted. The resulting emulsion comprised tabular grains having an average circle-corresponding diameter of 0.35 μm and an average thickness of 0.15 μm. The thus-obtained emulsion was designated as Emulsion 4-M.

Preparation of Emulsions 4-N to 4-O

Emulsions 4-N to 4-O as shown in Table 6 were prepared in the same manner as for Emulsion 4-M except for changing the amount of silver nitrate contained in Aqueous Silver Nitrate Solution (A) and Aqueous Silver Nitrate Solution (B), the addition time, the amount of potassium iodide contained in Aqueous Solution (C) and the pAg at the time of adding Aqueous Silver Nitrate Solution (B) and Aqueous Solution (C).

Preparation of Emulsion 4-Q

Emulsion 4-Q was prepared in the same manner as Emulsion Em-J in Example 5 of JP-A-63-220238.

Each of Emulsions 4-B to 4-Q prepared above was subjected to optimal spectral sensitization and optimal chemical sensitization in the same manner as Emulsion 4-A.

The aspect ratio, the circle-corresponding diameter, the dislocation line length/grain size, the coefficient of variation and the surface silver iodide content of each sample are shown in Table 6.

TABLE 6

| Emulsion | Aspect Ratio | Circle-corresponding Diameter (μ) | Dislocation Line Length/ Grain Size | Coefficient of Variation (%) | Surface Silver Iodide Content (mol %) | Use of I-Releasing Agent | Remarks |
|---|---|---|---|---|---|---|---|
| 4-A | 2.3 | 0.35 | 0.25 | 30 | 2 | none | Invention |
| 4-B | 2.3 | 0.35 | 0.20 | 30 | 2 | none | Invention |
| 4-C | 2.3 | 0.35 | 0.15 | 30 | 2 | none | Comparison |
| 4-D | 2.3 | 0.35 | 0.10 | 30 | 2 | none | Comparison |
| 4-E | 2.3 | 0.35 | 0.25 | 25 | 2 | none | Invention |
| 4-F | 2.3 | 0.35 | 0.25 | 20 | 2 | none | Invention |
| 4-G | 2.3 | 0.35 | 0.15 | 25 | 2 | none | Comparison |
| 4-H | 2.3 | 0.35 | 0.15 | 20 | 2 | none | Comparison |
| 4-I | 2.3 | 0.35 | 0.25 | 25 | 3 | none | Invention |
| 4-J | 2.3 | 0.35 | 0.25 | 25 | 4 | none | Invention |
| 4-K | 2.3 | 0.35 | 0.15 | 25 | 3 | none | Comparison |
| 4-L | 2.3 | 0.35 | 0.15 | 25 | 4 | none | Comparison |
| 4-M | 2.3 | 0.35 | 0.25 | 30 | 2 | used | Invention |
| 4-N | 2.3 | 0.35 | 0.15 | 30 | 2 | used | Comparison |
| 4-O | 2.3 | 0.35 | 0.25 | 20 | 2 | used | Invention |

TABLE 6-continued

| Emulsion | Aspect Ratio | Circle-corresponding Diameter (μ) | Dislocation Line Length/ Grain Size | Coefficient of Variation (%) | Surface Silver Iodide Content (mol %) | Use of I-Releasing Agent | Remarks |
|---|---|---|---|---|---|---|---|
| 4-P | 6.5 | 0.49 | 0.20 | 30 | 4 | none | Invention |
| 4-Q | 6.5 | 0.49 | 0.15 | 30 | 4 | none | Comparison |

(2) Preparation of Coated Sample and Evaluation Thereof

Coated Samples 401 to 417 were prepared by coating each emulsion shown in Table 6 and a protective layer on a cellulose triacetate film support having provided thereon an undercoat layer in an amount as shown in Table A in Example 1.

These samples were allowed to stand at 40° C. in a condition of 70% RH for 14 hours and each sample was exposed through a continuous wedge for 1/100 second and color developed as shown in Table B in Example 1 using processing solutions each having the same composition as used in Example 1.

Each of the processed samples were measured on the density through a green filter in the same manner as in Example 1. From the results obtained, the sensitivity and the fog value of each sample were obtained in the same manner as in Example 1.

The results obtained are shown in Table 7.

TABLE 7

| Sample | Emulsion Used | Sensitivity | Gradation | Remarks |
|---|---|---|---|---|
| 401 | 4-A | 170 | 188 | Invention |
| 402 | 4-B | 150 | 168 | Invention |
| 403 | 4-C | 100 | 100 | Comparison |
| 404 | 4-D | 90 | 95 | Comparison |
| 405 | 4-E | 170 | 198 | Invention |
| 406 | 4-F | 170 | 208 | Invention |
| 407 | 4-G | 100 | 100 | Comparison |
| 408 | 4-H | 100 | 103 | Comparison |
| 409 | 4-I | 170 | 188 | Invention |
| 410 | 4-J | 170 | 148 | Invention |
| 411 | 4-K | 100 | 100 | Comparison |
| 412 | 4-L | 95 | 98 | Comparison |
| 413 | 4-M | 200 | 188 | Invention |
| 414 | 4-N | 110 | 100 | Comparison |
| 415 | 4-O | 200 | 218 | Invention |
| 416 | 4-P | 160 | 160 | Invention |
| 417 | 4-Q | 90 | 80 | Comparison |

In Table 7, the sensitivity and the gradation of 401 to 417 each is shown as a relative value to that of Sample 403 taken as 100.

The change in the performance resulting from the variation in the dislocation line length/grain size can be compared among Samples 401 to 404. As a result of the comparison, it is seen that Samples 401 and 402 according to the present invention exhibited high sensitivity and hard gradation as compared with Samples 403 and 404, thus the effect of the present invention is very outstanding. It is also seen that the photographic properties were greatly improved when the dislocation line length/grain size was 0.2 or more.

The samples different in the coefficient of variation are described below.

The comparison of samples different in the coefficient of variation may be made among Samples 401, 405 and 406 of the present invention or Comparative Samples 403, 407 and 408. On the examination of the sensitivity and the gradation of Comparative Samples 403, 407 and 408, it is seen that the change in the performance due to the coefficient of variation is small. On the other hand, on the comparison among Samples 401, 405 and 406 of the present invention, preferred photographic properties such as large gradation and hard gradation are provided particularly when the coefficient of variation is 25% or less.

Then, the change in the surface silver iodide content is described below. The comparison of the surface silver iodide content may be made among Samples 405, 409 and 410 of the present invention or Comparative Samples 407, 411 and 412. On the examination of the sensitivity and the gradation of Comparative Samples 407, 411 and 412, the change in properties due to the surface silver iodide content is found small. On the other hand, on the comparison among Samples 405, 409 and 410 of the present invention, it is seen that preferred photographic properties such as large gradation and hard gradation are exhibited particularly when the surface silver iodide content is 3 mol % or less.

Now, the change in the performance due to the use of an iodide ion-releasing agent is described below. This change may be examined by comparing Comparative Samples 403 and 414 or Samples 401 and 413 of the present invention. A high sensitivity can be obtained by using an iodide ion-releasing agent even when Comparative Sample 414 is compared with Comparative Sample 403. However, the increase in the sensitivity seen in Sample 413 using an iodide ion-releasing agent from that of Sample 401 of the present invention is by far larger than the increase seen in Sample 414 from Sample 403, thus it is seen that the effect due to the iodide ion-releasing agent is great particularly in the sample of the present invention.

Then, the comparison will be made with the prior art technique. In Sample 417, Emulsion 4-Q according to Example 5 of JP-A-63-220238 is used. This sample is compared with Sample 416 prepared by using Emulsion 4-P of the present invention having the same circle-corresponding diameter and the same aspect ratio as in the comparative sample. Sample 416 according to the present invention is superior to Sample 417 both in the sensitivity and the granularity, thus the effect of the present invention is conspicuous.

EXAMPLE 5

(1) Preparation of Emulsions 5-A to 5-D

Tabular Silver Iodobromide Emulsion (Em-2) having a circle-corresponding diameter of 1.1 μm, an average aspect ratio of 4.0, a coefficient of variation of 18% and a sphere-corresponding diameter of 0.8 μm was prepared in the same manner as in the preparation of Tabular Silver Iodobromide Emulsion (Em-1) in Example 2. Also, Emulsions 5-A to 5-D shown in Table 8 were prepared in the same manner as in Example 4.

TABLE 8

| Sample | Emulsion | Circle-corresponding Diameter (μ) | Aspect Ratio | Dislocation Line Length/ Grain Size | Sensitivity | Gradation | Remarks |
|---|---|---|---|---|---|---|---|
| 501 | 5-A | 1.1 | 4.0 | 0.10 | 100 | 100 | Out of the Invention |
| 502 | 5-B | " | " | 0.15 | 100 | 100 | Out of the Invention |
| 503 | 5-C | " | " | 0.20 | 100 | 100 | Out of the Invention |
| 504 | 5-D | " | " | 0.25 | 100 | 100 | Out of the Invention |

The sensitivity and the gradation each is shown as a relative value to that of Sample 501 taken as 100.

Each emulsion was subjected to optimal chemical sensitization and the preparation of coating samples and evaluation were conducted in the same manner as in Example 1.

The results obtained are also shown in Table 8.

In this example, a test was conducted on tabular grains out of the present invention having a circle-corresponding diameter of 1.1 μm. No large change in the photographic properties was observed between 0.10 and 0.25 of the dislocation line length/grain size. In other words, no particular effect is provided on the grain in the large size region by specifying the ratio of the dislocation line length to the grain size and it is seen that the specific ratio is peculiarly important only on the grains having a small circle-corresponding diameter within the region of the present invention.

EXAMPLE 6

1) Support

The support used in this example was prepared in the same manner as in Example 3.

2) Coating of Undercoat Layer

After treating the above-described support in the same manner as in Example 3, an undercoating solution having the same composition as in Example 3 was coated on each surface of the support to provide an undercoat layer on the high temperature side at the stretching.

3) Coating of Backing Layer

As the backing layer on one surface of the above-described support after undercoating, an antistatic layer, a magnetic recording layer and a slipping layer were provided in the same manner as in Example 3.

4) Coating of Light-Sensitive Layer

Then, the layers each having the same composition as in Example 3 were coated in a superposed manner on the side opposite to the backing layer obtained above to provide a color negative photographic film.

Emulsions 4-A to 4-Q prepared in Example 4 were incorporated into the third layer (low-sensitivity red-sensitive emulsion layer) and the films were designated as Samples 601 to 617, respectively.

Also, in order to obtain good preservability, processability, pressure durability, antimold/antifungal property, antistatic property and coatability, the same additives as used in Example 3 were used appropriately.

Each sample was processed in the same manner as in Example 3 and the sensitivity and the granularity were obtained in the same manner as in Example 3.

The results are shown in Table 9.

TABLE 9

| Sample | Emulsion | Sensitivity (density: 1.8) | Sensitivity (density: 2.5) | Granularity (density: 1.8) | Remarks |
|---|---|---|---|---|---|
| 601 | 4-A | 180 | 208 | 110 | Invention |
| 602 | 4-B | 170 | 188 | 105 | Invention |
| 603 | 4-C | 100 | 100 | 100 | Comparison |
| 604 | 4-D | 90 | 95 | 95 | Comparison |
| 605 | 4-E | 180 | 218 | 115 | Invention |
| 606 | 4-F | 180 | 228 | 115 | Invention |
| 607 | 4-G | 100 | 100 | 100 | Comparison |
| 608 | 4-H | 100 | 103 | 100 | Comparison |
| 609 | 4-I | 180 | 208 | 110 | Invention |
| 610 | 4-J | 180 | 168 | 105 | Invention |
| 611 | 4-K | 100 | 100 | 100 | Comparison |
| 612 | 4-L | 95 | 98 | 90 | Comparison |
| 613 | 4-M | 210 | 208 | 110 | Invention |
| 614 | 4-N | 110 | 100 | 100 | Comparison |
| 615 | 4-O | 210 | 228 | 120 | Invention |
| 616 | 4-P | 170 | 180 | 105 | Invention |
| 617 | 4-Q | 90 | 80 | 85 | Comparison |

The sensitivity and the granularity each is shown as a relative value to that of Sample 603 taken as 100. The larger numeral indicates higher sensitivity or superior granularity.

It is seen from Table 9 that the samples using the emulsion of the present invention exhibited improved granularity and at the same time, high sensitivity as compared with comparative samples, thus the effect of the present invention is conspicuous.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising silver halide tabular grains having integrated therein dislocation lines and having an aspect ratio of 1.5 or more and a circle-corresponding diameter of 0.6 μm or less, wherein the tabular grains having a ratio of the average dislocation line length to the grain size of 0.2 or more occupy 50% or more of the total projected area; said tabular grains having a surface silver iodide content of 3 mol % or less.

2. The silver halide photographic emulsion as claimed in claim 1, wherein said tabular grains in said silver halide emulsion have a monodisperse grain size distribution.

3. The silver halide photographic emulsion as claimed in claim 1, wherein during the formation of said silver halide tabular grains, iodide ions were abruptly produced.

4. The silver halide photographic emulsion as claimed in claim 1, wherein said ratio of average dislocation line length to the grain size is within the range of from 0.20 to 0.75.

5. The silver halide photographic emulsion as claimed in claim 1, wherein said ratio of average dislocation line length to the grain size is within the range of from 0.20 to 0.50.

6. A silver halide photographic material comprising a support having thereon at least one silver halide emulsion layer, wherein said silver halide emulsion layer comprises a silver halide emulsion which comprises silver halide tabular grains having integrated therein dislocation lines and having an aspect ratio of 1.5 or more and a circle-corresponding diameter of 0.6 $\mu$m or less, wherein the tabular grains having a ratio of the average dislocation line length to the grain size of 0.2 or more occupy 50% or more of the total projected area.

7. The silver halide photographic material as claimed in claim 6, wherein said tabular grains in said silver halide emulsion have a monodisperse grain size distribution.

8. The silver halide photographic material as claimed in claim 6, wherein said tabular silver halide grains have a surface silver iodide content of 3 mol % or less.

9. The silver halide photographic material as claimed in claim 6, wherein during the formation of said silver halide tabular grains, iodide ions were abruptly produced.

10. The silver halide photographic material as claimed in claim 6, wherein said ratio of average dislocation line length to the grain size is within the range of from 0.20 to 0.75.

11. The silver halide photographic material as claimed in claim 6, wherein said ratio of average dislocation line length to the grain size is within the range of from 0.20 to 0.50.

* * * * *